US008756879B2

(12) United States Patent
Cempulik et al.

(10) Patent No.: US 8,756,879 B2
(45) Date of Patent: Jun. 24, 2014

(54) SPACER PROFILE AND INSULATING PANE UNIT HAVING SUCH A SPACER PROFILE

(75) Inventors: Peter Cempulik, Kassel (DE); Joerg Lenz, Kassel (DE); Petra Sommer, Kassel (DE)

(73) Assignee: Technoform Glass Insulation Holding GmbH, Kassel (DE)

( * ) Notice: Subject to any disclaimer, the term of this patent is extended or adjusted under 35 U.S.C. 154(b) by 0 days.

(21) Appl. No.: 13/881,999

(22) PCT Filed: Oct. 26, 2011

(86) PCT No.: PCT/EP2011/005405

§ 371 (c)(1),
(2), (4) Date: Apr. 26, 2013

(87) PCT Pub. No.: WO2012/055553

PCT Pub. Date: May 3, 2012

(65) Prior Publication Data

US 2013/0212957 A1 Aug. 22, 2013

(30) Foreign Application Priority Data

Oct. 27, 2010 (DE) ..... 10 2010 049 806

(51) Int. Cl.
*E06B 7/12* (2006.01)
*E06B 7/00* (2006.01)
*E06B 3/663* (2006.01)

(52) U.S. Cl.
CPC ..... *E06B 3/663* (2013.01); *E06B 3/66309* (2013.01)
USPC ..... 52/172; 52/204.595

(58) Field of Classification Search
CPC ..... E06B 1/00; E06B 3/663; E06B 3/66304; E06B 3/66309; E06B 3/66319; E06B 2003/663; E06B 2003/66309; E06B 2003/66333; E06B 2003/6638; E06B 2003/66385
USPC ..... 52/786.1, 786.13, 656.1, 656.2, 656.5, 52/786.11, 788.1, 795.1, 800.1, 204.593; 403/331, 253
See application file for complete search history.

(56) References Cited

U.S. PATENT DOCUMENTS 2,094,381 A * 9/1937 Slayter ..... 52/786.13
2,235,680 A 3/1941 Haven et al.

(Continued)

FOREIGN PATENT DOCUMENTS

CA 2269715 5/1998
DE 26 14 236 10/1977

(Continued)

OTHER PUBLICATIONS

English translation of Written Opinion for parent International application No. PCT/EP2011/005405.

(Continued)

*Primary Examiner* — Mark Wendell
*Assistant Examiner* — Keith Minter
(74) *Attorney, Agent, or Firm* — J-Tek Law PLLC; Jeffrey D. Tekanic; Scott T. Wakeman

(57) ABSTRACT

A spacer profile for a spacer frame of an insulating pane unit includes a hollow profile body made of plastic with a chamber defined therein. The hollow profile body extends in a longitudinal direction and includes an inner wall, an outer wall, a first side wall and a second side wall, which are connected to the inner and outer walls to form the chamber. First and second reinforcing layers made of a metallic material respectively extend on the first and second side walls and partially on the outer wall so as to be spaced apart by a first distance. A diffusion barrier layer is formed directly on the outer wall between the first and second reinforcing layers and is connected thereto in a diffusion-proof manner in order to form a heat-insulating diffusion barrier. An insulating pane unit includes at least two panes with such a spacer frame disposed therebetween.

20 Claims, 12 Drawing Sheets

(56) References Cited

U.S. PATENT DOCUMENTS

| | | | | | |
|---|---|---|---|---|---|
| 2,525,717 | A | | 10/1950 | Ottenheimer | |
| 2,741,809 | A | | 4/1956 | Englehart et al. | |
| 2,838,809 | A | | 6/1958 | Zeolla et al. | |
| 2,934,801 | A | | 5/1960 | Blaszkowski | |
| 2,974,377 | A | | 3/1961 | Kunkle | |
| 3,168,089 | A | * | 2/1965 | Larkin | 126/200 |
| 3,758,996 | A | | 9/1973 | Bowser | |
| 3,872,198 | A | | 3/1975 | Britton | |
| 3,998,680 | A | * | 12/1976 | Flint | 156/109 |
| 4,015,394 | A | | 4/1977 | Kessler | |
| 4,080,482 | A | * | 3/1978 | Lacombe | 428/34 |
| 4,149,348 | A | | 4/1979 | Pyzewski | |
| 4,407,105 | A | | 10/1983 | Frank | |
| 4,479,988 | A | * | 10/1984 | Dawson | 428/34 |
| 4,658,553 | A | * | 4/1987 | Shinagawa | 52/172 |
| 5,079,054 | A | * | 1/1992 | Davies | 428/35.8 |
| 5,125,195 | A | * | 6/1992 | Brede | 52/171.3 |
| 5,209,034 | A | * | 5/1993 | Box et al. | 52/171.3 |
| 5,290,611 | A | * | 3/1994 | Taylor | 428/34 |
| 5,302,425 | A | * | 4/1994 | Taylor | 428/34 |
| 5,313,762 | A | * | 5/1994 | Guillemet | 52/786.13 |
| 5,424,111 | A | * | 6/1995 | Farbstein | 428/137 |
| 5,439,716 | A | * | 8/1995 | Larsen | 428/34 |
| 5,460,862 | A | | 10/1995 | Roller | |
| 5,679,419 | A | * | 10/1997 | Larsen | 428/34 |
| 5,851,627 | A | * | 12/1998 | Farbstein | 428/137 |
| 5,962,090 | A | * | 10/1999 | Trautz | 428/34 |
| 6,061,994 | A | * | 5/2000 | Goer et al. | 52/786.13 |
| 6,192,652 | B1 | | 2/2001 | Goer et al. | |
| 6,223,414 | B1 | * | 5/2001 | Hodek et al. | 29/527.1 |
| 6,250,045 | B1 | * | 6/2001 | Goer et al. | 52/786.13 |
| 6,339,909 | B1 | | 1/2002 | Brunnhofer et al. | |
| 6,351,923 | B1 | * | 3/2002 | Peterson | 52/786.13 |
| 6,355,328 | B1 | | 3/2002 | Baratuci et al. | |
| 6,389,779 | B1 | | 5/2002 | Brunnhofer | |
| 6,457,294 | B1 | * | 10/2002 | Virnelson et al. | 52/786.13 |
| 6,537,629 | B1 | | 3/2003 | Ensinger | |
| 6,613,404 | B2 | * | 9/2003 | Johnson | 428/34 |
| 6,796,102 | B2 | * | 9/2004 | Virnelson et al. | 52/786.13 |
| 6,989,188 | B2 | * | 1/2006 | Brunnhofer et al. | 428/188 |
| 7,081,300 | B2 | | 7/2006 | Laurence et al. | |
| 7,827,760 | B2 | * | 11/2010 | Brunnhofer et al. | 52/786.13 |
| 7,997,037 | B2 | * | 8/2011 | Crandell et al. | 52/204.593 |
| 8,453,415 | B2 | * | 6/2013 | Brunnhofer et al. | 52/786.13 |
| 2001/0001357 | A1 | * | 5/2001 | Reichert | 52/786.13 |
| 2003/0037493 | A1 | | 2/2003 | Guhl et al. | |
| 2004/0163347 | A1 | * | 8/2004 | Hodek et al. | 52/506.01 |
| 2005/0034386 | A1 | * | 2/2005 | Crandell et al. | 52/204.5 |
| 2006/0130427 | A1 | * | 6/2006 | Hodek et al. | 52/786.13 |
| 2006/0150577 | A1 | * | 7/2006 | Hodek et al. | 52/786.13 |
| 2006/0162281 | A1 | * | 7/2006 | Pettit et al. | 52/786.13 |
| 2006/0260227 | A1 | * | 11/2006 | Winfield | 52/204.593 |
| 2007/0261358 | A1 | | 11/2007 | Davis et al. | |
| 2008/0053037 | A1 | * | 3/2008 | Gallagher | 52/786.13 |
| 2008/0110109 | A1 | | 5/2008 | Hermens | |
| 2008/0134596 | A1 | | 6/2008 | Brunnhofer et al. | |
| 2009/0120019 | A1 | * | 5/2009 | Trpkovski | 52/204.595 |
| 2009/0120035 | A1 | * | 5/2009 | Trpkovski | 52/786.13 |
| 2009/0243802 | A1 | * | 10/2009 | Wolf et al. | 340/10.1 |
| 2010/0011703 | A1 | * | 1/2010 | Seele et al. | 52/786.1 |
| 2010/0107526 | A1 | | 5/2010 | Brunnhofer et al. | |
| 2011/0041427 | A1 | * | 2/2011 | Bouesnard | 52/171.3 |
| 2012/0297707 | A1 | * | 11/2012 | Lenz et al. | 52/204.593 |
| 2012/0297708 | A1 | | 11/2012 | Brunnhofer et al. | |
| 2013/0316184 | A1 | * | 11/2013 | Siodla et al. | 428/593 |

FOREIGN PATENT DOCUMENTS

| | | | |
|---|---|---|---|
| DE | 43 41 905 | | 6/1994 |
| DE | 94 08 764 | | 11/1995 |
| DE | 195 30 838 | A1 | 2/1997 |
| DE | 196 44 346 | | 4/1998 |
| DE | 198 05 265 | | 4/1999 |
| DE | 198 05 348 | A1 | 8/1999 |
| DE | 198 07 454 | A1 | 8/1999 |
| DE | 198 32 731 | A1 | 6/2000 |
| DE | 20 2005 016 444 | U1 | 3/2006 |
| DE | 20 2005 019 973 | U1 | 4/2006 |
| DE | 10 2004 062 060 | | 5/2006 |
| EP | 0 029 984 | | 6/1981 |
| EP | 601 488 | A2 | 6/1994 |
| EP | 1 017 923 | B1 | 8/2001 |
| EP | 0 953 715 | B1 | 4/2004 |
| EP | 1 099 038 | B1 | 4/2004 |
| FR | 1 475 287 | | 3/1967 |
| GB | 1 520 257 | | 8/1978 |
| WO | 00/05474 | | 2/2000 |
| WO | 03024715 | A | 3/2003 |
| WO | 2006/027146 | | 3/2006 |
| WO | 2006025953 | A | 3/2006 |

OTHER PUBLICATIONS

English translation of International Search Report for parent International application No. PCT/EP2011/005405.

Examination Report dated Oct. 27, 2010 from the German Patent & Trademark Office in priority German patent application No. 10 2010 049 806.8, including English translation of substantive portion thereof.

Office Action mailed Jun. 26, 2013 in related U.S. Appl. No. 13/575,384.

* cited by examiner

SPACER PROFILE AND INSULATING PANE UNIT HAVING SUCH A SPACER PROFILE

CROSS-REFERENCE

This application is the U.S. national stage of International Application No. PCT/EP2011/005405 filed on Oct. 26, 2011, which claims priority to German utility model application no. 20 2010 049 806.8 filed on Oct. 27, 2010.

TECHNICAL FIELD

The present invention concerns a spacer profile for use in insulating pane units having such a spacer profile and an insulating pane unit having such a spacer profile.

RELATED ART

Insulating pane units having at least two panes 151, 152 that are held spaced apart from one another inside the insulating pane unit are well-known (see FIG. 16). The panes 151, 152 are normally made of inorganic or organic glass or of other materials such as Plexiglas. The spacing of the panes 151, 152 is usually secured by a spacer frame 150, which is made of at least one composite material spacer profile 100. Composite material spacer profiles, which are also known as composite spacer profiles, are provided from a plastic profile and a metal layer serving as a diffusion barrier, and are shown, e.g., in DE 198 32 731 A1 (family member WO 2000/005475 A1), EP 0 953 715 A2 (family member U.S. Pat. No. 6,196,652) or EP 1 017 923 A1 (family member U.S. Pat. No. 6,339,909).

The space 153 between the panes is preferably filled with an insulating inert gas, such as, for example, argon, krypton, xenon, etc. The filling gas should not be able to leak out from the space 153 between the panes over a long period of time. Likewise, ambient air and/or components thereof, such as nitrogen, oxygen, water, etc., should not be able to penetrate into the space 153 between the panes. For this reason, the spacer profile 100 should be formed such that diffusion between the interior space 153 of the panes and the outside environment is prevented. Therefore, spacer profiles include a diffusion barrier 157, which prevents diffusion of the filling gas from the space 153 between the panes into the outer environment through the spacer profile 100.

Furthermore, to achieve low thermal conduction in these insulating pane units, in particular the heat transfer of the edge bond, i.e. of the bond of the edge of the insulating pane unit, of panes 151, 152 and the spacer frame 150, plays a very important role. Insulating pane units, which ensure high thermal insulation at the edge connection, satisfy the so-called "warm edge" condition in accordance with the meaning of the term in the art. Therefore, the spacer profiles 100 should have good thermal insulation.

The spacer frame 150 is preferably bent from a one-piece spacer profile 100. To close the frame 150, the two ends of the spacer profile 100 are connected using a connector. If the spacer frame 150 is assembled from a plurality of spacer profile pieces 100, more connectors are also necessary. With regard to both manufacturing costs and insulation properties, it is preferable to provide only one connection point.

The bending of the frame 150 from the spacer profile 100 takes place, for example, by cold bending (at a room temperature of approximately 20° C.). In this process, the problem of wrinkle formation arises at the bends.

The spacer profile should be bent with the least possible wrinkle formation and at the same time have high strength and bending stiffness as well.

A spacer profile is known from EP 0 601 488 A2 (family member U.S. Pat. No. 5,460,862), in which an additional reinforcing insert is embedded in the plastic on the profile side that faces towards the space between the panes when assembled.

Further, spacers are known that have a comparatively thin continuous reinforcing layer made of metallic material on the profile body made of plastic. Such spacers lose their diffusion impermeability when bent at 90° and have comparatively thick plastic profile walls, so they do not sag too much.

A spacer profile is known from DE 198 32 731 A1 (family member WO 2000/005475 A1), whose profile body consists of poorly heat-conductive material, and is connected to a diffusion-proof layer made of a good heat conducting material extending substantially over its entire width. The diffusion-proof layer made of good heat conducting material has an area of reduced thermal conduction transverse to the longitudinal direction of the spacer profile, which area extends in the longitudinal direction of the spacer profile.

SUMMARY

It is an object of the present teachings to disclose improved spacer profiles, in which in particular the thermal insulation is improved with good strength and/or bending stiffness and with good wrinkle formation properties during bending. Insulating pane units comprising such spacer profiles are also disclosed.

According to a first aspect of the present teachings, a spacer profile for use in a spacer frame of an insulating pane unit for door- or window- or facade-elements is disclosed, which insulating pane unit comprises at least first and second panes having an intervening space defined therebetween. The spacer profile preferably comprises:

a hollow profile body made of a first synthetic material and having a chamber for accommodating hygroscopic material defined therein, the hollow profile body extending in a longitudinal direction (Z) and comprising:

an inner wall, which faces the intervening space between the panes of the insulating pane unit in an assembled state of the insulating pane unit, an outer wall on the side of the chamber that is opposite to the inner wall in a height direction (Y), which is perpendicular to the longitudinal direction (Z), and lateral in a transverse direction (X), which is perpendicular to the longitudinal direction (Z) and to the height direction (Y), a first side wall and an opposing second side wall, which are connected with the inner wall and the outer wall so as to form the chamber, a first reinforcement layer made of a first metallic material having a first specific heat conductivity ($\lambda_1$), the first reinforcement layer extending in the longitudinal direction (Z) in one piece on, and optionally in at least one section within, the first side wall with a constant cross section perpendicular to and in the longitudinal direction, and having a first thickness (d1), a second reinforcement layer made of a second metallic material having a second specific heat conductivity ($\lambda_2$), the second reinforcement layer extending in the longitudinal direction (Z) in one piece on, and optionally in at least one section within, the second side wall with a constant cross-section perpendicular to and in the longitudinal direction (Z), being spaced by a first distance from the first reinforcement layer, and having a second thickness (d2), and a diffusion barrier layer having a third thickness (d3; d33) and a third specific heat conductivity ($\lambda_3$, $\lambda_{33}$), the diffusion barrier layer being formed on the outer wall at least between the first reinforcement layer and the second reinforcement layer and being connected in a diffusion-proof manner with the first reinforcement layer and the second reinforcement layer to form a diffusion barrier, wherein the product of the third specific heat conductivity ($\lambda_3$, $\lambda_{33}$) and the third thickness (d3; d33) is smaller than both (i) the product of the first specific heat conductivity ($\lambda_1$) and the first thickness (d1) and (ii) the product of the second specific heat conductivity ($\lambda_2$) and the second thickness (d2), and the spacer profile is formed such that, during bending of the spacer profile by 90° about an axis parallel to the transverse direction (X) with the inner wall lying further inward than the outer wall with reference to the bending radius, the diffusion barrier layer is disposed substantially on the neutral axis.

According to a second aspect of the present teachings, a spacer profile for use in a spacer frame of an insulating pane unit for door- or window- or facade-elements is disclosed, which insulating pane unit comprises at least first and second panes having an intervening space defined therebetween. The spacer profile preferably comprises:

a hollow profile body made of a first synthetic material and having a chamber for accommodating hygroscopic material defined therein, the hollow profile body extending in a longitudinal direction (Z) and comprising:

an inner wall, which faces the intervening space between the panes of the insulating pane unit in an assembled state of the insulating pane unit, an outer wall on the side of the chamber that is opposite to the inner wall in a height direction (Y), which is perpendicular to the longitudinal direction (Z), and lateral in a transverse direction (X), which is perpendicular to the longitudinal direction (Z) and to the height direction (Y), a first side wall and an opposing second side wall, which are connected with the inner wall and the outer wall so as to form the chamber, a first reinforcement layer made of a first metallic material having a first specific heat conductivity ($\lambda_1$), the first reinforcement layer extending in the longitudinal direction (Z) in one piece on, and optionally in at least one section within, the first side wall with a constant cross section perpendicular to and in the longitudinal direction, and having a first thickness (d1), a second reinforcement layer made of a second metallic material having a second specific heat conductivity ($\lambda_2$), the second reinforcement layer extending in the longitudinal direction (Z) in one piece on, and optionally in at least one section within, the second side wall with a constant cross-section perpendicular to and in the longitudinal direction (Z), being spaced by a first distance from the first reinforcement layer, and having a second thickness (d2), and a diffusion barrier layer comprising at least a first layer made of a diffusion-proof EVOH-plastic material having a third thickness (d33) and a third specific heat conductivity ($\lambda_{33}$), the diffusion barrier layer being formed on the outer wall at least between the first reinforcement layer and the second reinforcement layer and being connected in a diffusion-proof manner with the first reinforcement layer and the second reinforcement layer to form a diffusion barrier, wherein the product of the third specific heat conductivity ($\lambda_3$, $\lambda_{33}$), and the third thickness (d33) is smaller than both (i) the product of the first specific heat conductivity ($\lambda_1$) and the first thickness (d1) and (ii) the product of the second specific heat conductivity ($\lambda_2$) and the second thickness (d2).

According to a third aspect of the present teachings, an insulating pane unit preferably comprises:

at least first and second panes arranged so as to oppose each other and be spaced apart to define an intervening space therebetween, and a spacer frame made of a spacer profile according to any embodiment or aspect of the present teachings disclosed herein, the spacer frame being arranged between the panes such that the outer sides of the side walls in the lateral direction are bonded by a diffusion-proof adhesive material to the respective sides of the panes that face the outer sides of the side walls and such that the spacer frame, in part, delimits the intervening space between the panes.

The diffusion impermeability is ensured on one hand by a diffusion barrier, which is formed by the two reinforcing layers and the diffusion barrier layer and is located in the neutral line during the bending of the spacer profile. On the other hand, the hollow profile body may be at least partially manufactured from a diffusion-proof plastic material, such as an EVOH material, that ensures diffusion impermeability. In this case a diffusion barrier layer also is formed between the reinforcing layers, namely the part of the outer wall that is located between the reinforcing layers. Substantially less heat is transmitted through the diffusion barrier layer than through the reinforcing layers. The spacer profile having the two spaced-apart reinforcing layers, which are connected with each other in a central section by a diffusion barrier layer, has a much lower thermal conductivity for the same diffusion impermeability than a comparable conventional spacer profile. At the same time, the spacer profile is stiffer and stronger. Furthermore, material can be saved, whereby the manufacturing costs and weight are reduced. By suitably designing the geometry of the hollow profile body and the reinforcing layers, the diffusion barrier layer may be located, during the bending of the spacer, approximately on the neutral line (the zone of the material that experiences no stretching or compression during the bending) of the spacer profile. Therefore substantially no tensile stresses act on the diffusion barrier layer during the bending. For this reason, a diffusion barrier layer can be used, which is required to withstand little or no tensile forces. In addition, the diffusion barrier layer can be easily applied to the spacer profile.

BRIEF DESCRIPTION OF THE DRAWINGS

Other features and utilities will become apparent from the description of exemplary embodiments with reference to the Figures. The Figures show.

DETAILED DESCRIPTION OF THE INVENTION

Figure 1:
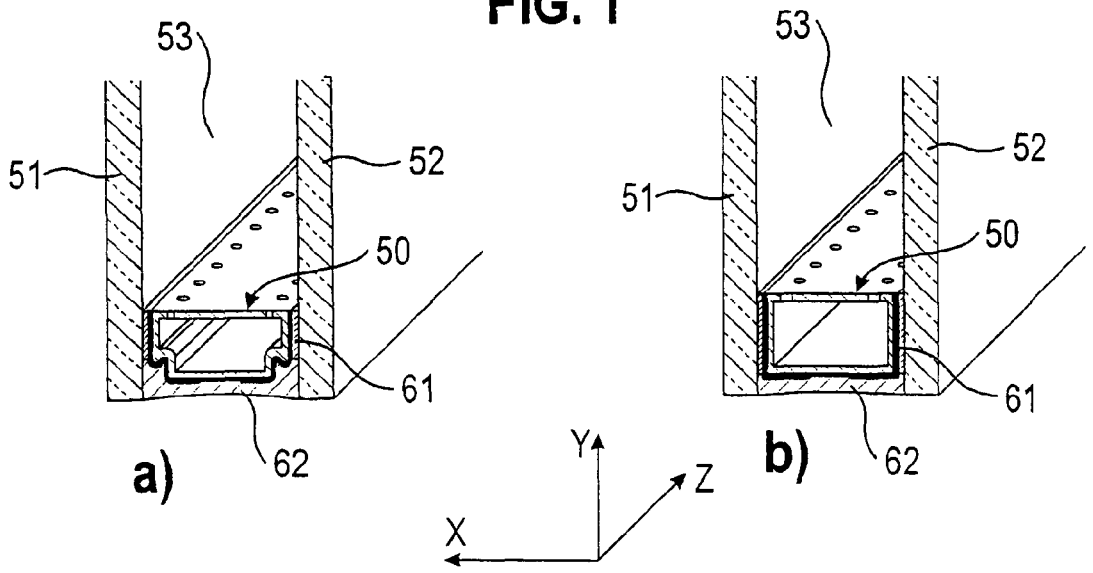
FIG. 1 in each of a) and b), a cross sectional perspective view of an assembled insulating pane unit having a spacer profile, adhesive material and sealing material disposed therebetween, FIG. 2 a schematic side view, partially cut open, of a bent spacer frame made of a spacer profile in the ideal state, FIG. 3 a cross sectional view of a spacer profile, in a) according to a first embodiment, in a U-configuration and with a narrow diffusion barrier layer, and in b) according to a second embodiment, in a U-configuration and with a wide diffusion barrier layer, FIG. 4 a cross sectional view of a spacer profile, in a) according to a third embodiment, in a W-configuration and with a narrow diffusion barrier layer, and in b) according to a fourth embodiment, in a W-configuration and with a wide diffusion barrier layer, FIG. 5 a cross sectional view of a spacer profile according to a fifth embodiment, in a) in a W-configuration and in b) in a U-configuration, FIG. 6 a cross sectional view of a spacer profile according to a sixth embodiment, in a) in a W-configuration and in b) in a U-configuration FIG. 7 a cross sectional view of a spacer profile according to a seventh embodiment, in a) in a W-configuration and in b) in a U-configuration, in c) an enlarged view of the portion surrounded by a circle in a) and in d) an enlarged view of the portion surrounded by a circle in b), FIG. 8 a cross sectional view of a spacer profile according to an eighth embodiment, in a) in a W-configuration and in b) in a U-configuration, FIG. 9 a cross sectional view of a spacer profile according to a ninth embodiment, in a) in a W-configuration and in b) in a U-configuration, FIG. 10 a cross sectional view of a spacer profile according to a tenth embodiment, in a) in a W-configuration and in b) in a U-configuration, FIG. 11 a cross sectional view of a spacer profile according to an eleventh embodiment, in a) in a W-configuration and in b) in a U-configuration, FIG. 12 a cross sectional view of a spacer profile according to a twelfth embodiment, in a) in a W-configuration and in b) in a U-configuration, FIG. 13 a view onto the outer wall of a spacer profile according to a thirteenth embodiment, and FIG. 14 a cross sectional view of a spacer profile according to a fourteenth embodiment, FIG. 15 a cross sectional view of the spacer profile according to the first embodiment after a bending procedure, FIG. 16 in each of a) and b), a cross sectional perspective view of an assembled insulating pane unit having a spacer profile, adhesive material and sealing material disposed therebetween, as known from the prior art, FIG. 17 in each a) and b), a cross sectional view of a spacer profile according to a fifteenth to nineteenth embodiment, FIG. 18 a cross sectional view of a spacer profile according to a twentieth embodiment, and FIG. 19 a section of a cross-sectional view of a spacer profile according to a twenty-first embodiment.

Hereinafter, embodiments will be described with reference to FIGS. 1-17. The same features are indicated with the same reference numerals in all Figures, wherein for reasons of clarity all reference numerals are not used in all Figures.

Figure 3A:
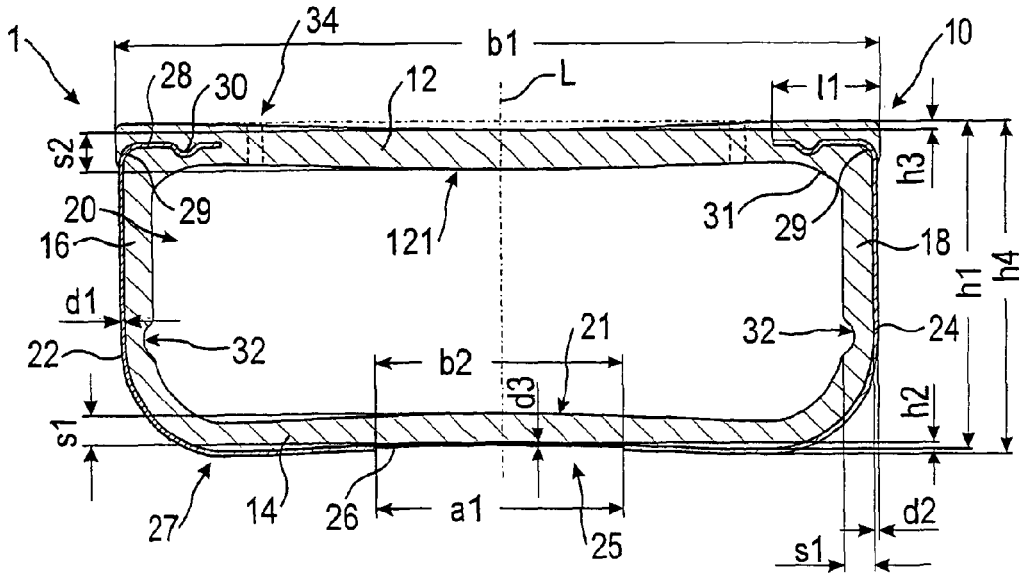

Furthermore, a spacer profile 1 will be described according to a first embodiment with reference to FIG. 3*a*). The spacer profile 1 is shown in FIG. 3*a*) in cross section perpendicular to a longitudinal direction Z, i.e. in the section in an X-Y plane, which is spanned by a transverse direction X, which is perpendicular to the longitudinal direction Z, and a height direction Y, which is perpendicular to the transverse direction X and the longitudinal direction Z. In the embodiment, the spacer profile 1 extends in the longitudinal direction Z with a symmetry plane L, which is centrally disposed in relation to the transverse direction X and extends parallel to the longitudinal direction Z and to the height direction Y.

The spacer profile 1 has a hollow profile body 10 made of a plastic material, which extends in the longitudinal direction Z with a constant cross-sectional shape and has a first width b1 in the transverse direction X and a first height h1 in the height direction Y. The hollow profile body 10 has an inner wall 12 in its height direction Y and an outer wall 14 on the side opposite the inner wall 12 in height direction Y. The outer edges in the transverse direction X of the inner wall 12 and the outer wall 14 are each connected to one another by a side wall 16, 18, which extends substantially parallel to height direction Y. The first side wall 16 is opposite to the second side wall 18 in the transverse direction X. The symmetry plane L extends substantially parallel to side walls 16, 18 and is disposed centrally between them. A chamber 20 is formed and/or delimited by the inner wall 12, the first side wall 16, the outer wall 14 and the second side wall 18, which are connected to one another.

The first side wall 16, the second side wall 18 and the outer wall 14 each have a first wall thickness s1. The inner wall 12 has a second wall thickness s2.

In accordance with the first embodiment, the junctions or connecting portions of the side walls 16, 18 to the outer wall 14 are each rounded in the cross-sectional view, formed here substantially in the shape of a quarter circle. A U-shape (U-configuration) is therefore created by the two side walls 16, 18 and the outer wall 14, on which the inner wall 12 is set as a lid. The junctions or connecting portions between the side walls 16, 18 and the inner wall 12 are therefore formed substantially right-angled in the cross section relative to the longitudinal direction Z, with a rounded connecting portion on the side facing the chamber 20. The hollow profile body 10 is preferably integrally manufactured by extrusion.

In this embodiment the outer wall 14 is formed slightly concave in relation to the chamber 20. This means that the outer wall 14 is curved towards the interior of chamber 20 in the height direction Y to form an arch 21. In the middle with respect to its edges in the transverse direction X, i.e. in the area of the symmetry plane L, the outer wall 14 is curved inwardly towards the chamber 20 by a second height h2.

In addition, the inner wall 12 is formed slightly concave in relation to the chamber 20 in this embodiment. This means that the inner wall 12 is curved towards the interior of the chamber 20 in the height direction Y to form an arch 121. In the middle with respect to its edges in the transverse direction X, i.e. in the area of the symmetry plane L, the inner wall 12 is curved inwardly towards the chamber 20 by a third height h3.

Preferably, the arches 21 are already formed in the plastic during the extrusion. However, they can also be formed directly after the extrusion or in a subsequent roll reshaping process.

In this embodiment two reinforcing layers 22, 24 extend directly on the hollow profile body 10, each on a large portion of the outer surfaces of the side walls 16, 18, which outer surfaces face away from the chamber 20, and on a portion of the outer side of the outer wall 14 that faces away from the chamber 20. A first reinforcing layer 22 extends integrally and continuously in the longitudinal direction Z with a constant cross-section directly on the (facing away from the chamber) outer side of the first side wall 16 from just below the inner wall 12 to and directly on the portion of the (facing away from the chamber) outer side of the outer wall 14 that faces towards the first side wall 16. A second reinforcing layer 24 extends integrally and continuously in the longitudinal direction Z with a constant cross-section directly on the (facing away from the chamber) outer side of the second side wall 18 from just below the inner wall 12 to and directly on the portion of the (facing away from the chamber) outer side of the outer wall 14 that faces towards the second side wall 18. The first reinforcing layer 22 is formed from a first diffusion-proof metallic material having a first specific thermal conductivity $\lambda_1$ and the second reinforcing layer 24 is formed from a second diffusion-proof metallic material having a second specific thermal conductivity $\lambda_2$.

To the extent the term "diffusion impermeability" or "diffusion-proof" is used herein with respect to the spacer profile or the materials forming the spacer profile, both vapor diffusion impermeability and gas diffusion impermeability are preferably meant for the gases-in-question (e.g., nitrogen, oxygen, water, etc., in particular argon) in the following description. The materials used are considered to be gas-proof or vapor-proof when preferably no more than 1% of the gases in the space 153 between the panes can leak out within one year. Diffusion impermeability is also equated with low diffusion in the sense that the applicable test standard EN 1279 Part 2+3 is preferably satisfied. This means that the finished spacer profile preferably satisfies the test standard EN 1279 Part 2+3.

The first and second reinforcing layer 22, 24 do not touch one another. The reinforcing layers 22, 24 are configured and arranged such that, with respect to transverse direction X, they are spaced from one another by a first distance a1. This means that between the reinforcing layers 22, 24, a section 25, which is central with respect to transverse direction X and extends in the transverse direction X over the first distance a1, remains free on the outer side of the outer wall 14. In this embodiment, the central section 25 has a second width b2 in the transverse direction X that corresponds to the first distance a1. No reinforcing layer is formed and/or disposed in or on this central section 25.

In this embodiment, the reinforcing layers 22, 24 extend symmetrically with respect to the symmetry plane L, so that the first reinforcing layer 22 and the second reinforcing layer 24 each have a distance a1/2 to the symmetry plane L. The reinforcing layers 22, 24 are molecular bonded directly with the corresponding walls. To the extent the term "molecular bonded directly" or "bonded" is used herein, direct bonding without any intermediate layers is meant in the following description. Specifically, in the present embodiment this means that the hollow profile body 10 and the reinforcing layers 22, 24 are permanently bonded together for example by co-extrusion of the hollow profile body 10 together with the reinforcing layers 22, 24 and/or optionally with the use of adhesion agents and no further layers are formed between the reinforcing layers 22, 24 and the hollow profile body 10.

The first reinforcing layer 22 has a constant first thickness d1. The second reinforcing layer 24 has a constant second thickness d2. The first thickness d1 and the second thickness d2 are the same in the present embodiment. Since the reinforcing layers 22, 24 are each formed on the outer side of the outer wall 14, the height of the hollow profile body 10 in the height direction Y is increased in this embodiment by the amount of thickness d1 or d2, so that the spacer profile 1 has an overall height h4=h1+d1. The first width b1 does not change, since the edges of the hollow profile body 10 in this embodiment are formed in the transverse direction X such that the reinforcing layers 22, 24 do not increase the first width b1. This means that the section of the side walls 16, 18, on which no reinforcing layers 22, 24 are formed, is formed in a correspondingly wider manner.

In the first embodiment, the end portions of the reinforcing layers 22, 24 opposite the outer wall 14 in the height direction Y have profile extension segments 28 that extend in the longitudinal direction Z. The extension segments 28 extend the reinforcing layers 22, 24 in the height direction Y to just below the inner wall 12. The term "profile" in this context means that the extension segment 28 is not exclusively a linear extension of the respective reinforcing layer 22, 24 in the height direction Y, but rather that a two-dimensional profile is formed in the two-dimensional representation of the cross section in the X-Y plane; for example the profile has one or more bends 29 of the extension segment 28.

In this embodiment, the extension segments 28 have, at the level of inner wall 12, a 90° bend 29 towards the symmetry plane L and into the inner wall 12. This means that the extension segment 28 protrudes into the inner wall 12. In addition, it has a groove 30 in the two-dimensional representation of the cross section in the X-Y plane. The extension segment 28 protrudes with a first length L1 in the transverse direction X from the outer side of the corresponding side wall 16, 18 of the hollow profile body 10 into the inner wall 12.

The extension segments 28 provide an improved bending property and an improved adhesion of the reinforcing layers 22, 24 on and/or in the hollow profile body 10. It is preferred when the extension segments 28 are arranged as close as possible to the outer side of the inner wall 12 facing away from chamber 20 (as close as possible to the space 53 between the panes), but are covered by the material of the inner wall 12. The extension segments 28 are each incorporated in an accommodation portion 31. Such an accommodation portion 31 is formed by the inner wall 12 and/or side wall 16, 18 and extends from the outer side of the inner wall 12 into the same and optionally into the corresponding side wall 16, 18 over a height in the height direction Y, which is less than 0.4 h1, preferably is less than 0.2 h1 and even more preferably less than 0.1 h1. The specified height of the accommodation portions 31 also defines the beginning of the extension segments 28. The accommodation portions 31 have at least the thickness s1 of the side walls 16, 18 in the transverse direction X. The accommodation portions preferably extend from the outer side of the side walls 16, 18 facing away from the chamber over a width<1.5 l1, more preferably over a width<1.2 l1 and even more preferably over a width of 1.1 l1 in the transverse direction X.

Optionally, the inner wall 12 and/or the side walls 16, 18 may have an increased wall thickness in the region of accommodation portions 31. This is shown in an exemplary manner in FIGS. 5, 6, 8 and 10.

The mass of each extension segment 28 is preferably at least 10% of the mass of the remaining portion of the respective reinforcing layer 22, 24 which is located above the center line of the spacer profile 1 in the vertical direction Y, preferably at least about 20%, more preferably at least 50%, and even more preferably at least 100%.

A diffusion barrier layer 26, which is preferably made of a third diffusion-proof metallic material having a third specific thermal conductivity $\lambda_3$, is directly applied onto the area of the outer side of the outer wall 14 on which no reinforcing layer 22, 24 is provided, i.e. on the central portion 25 with reference to the transverse direction X that extends over the first distance a1 in the transverse direction X. The diffusion barrier layer 26 may, however, also be formed from a different diffusion-proof material, such as a diffusion-proof plastic material. Such a plastic material is for example an ethylene-vinyl alcohol copolymer, which is also referred to as EVOH. The EVOH material distributed by NIPPON GOHSEI, under the product name "SoarnoL®", is preferably used. More preferably, it may be the product sold under the product name "SoarnoL® 29 mol %". More preferably, the diffusion barrier layer 26 is formed of several layers. The layers may comprise at least a first layer made of EVOH material and a second layer made of polyolefin, such as PE or PP. The first and second layers are preferably bonded by an adhesion agent.

The diffusion barrier layer 26 extends in the transverse direction X over the first distance a1 between the first reinforcing layer 22 and the second reinforcing layer 24 and in the longitudinal direction Z with a constant cross-sectional shape in a section X-Y perpendicular to the longitudinal direction L over the entire length of the spacer profile 1. The diffusion barrier layer 26 has a third thickness d3, which in this embodiment is smaller than the first thickness d1 and the second thickness is d2. The diffusion barrier layer 26 is bonded in a diffusion-proof manner to the first reinforcing layer 22 and to the second reinforcing layer 24. The diffusion barrier layer 26 is directly bonded in a diffusion-proof manner, for example by vapor deposition, lamination, adhesive bonding, welding, sputtering, galvanizing or rolling up with the reinforcing layers 22, 24 and the outer side of the outer wall 14. Preferably, the diffusion barrier layer 26 is directly bonded with the outer side of the outer wall 14 in a molecular bonded manner. It is bonded at its edges in the transverse direction X with the reinforcing layers 22, 24, for example, by an adhesion agent. Alternatively, the edges of the diffusion barrier layer 26 are directly bonded with the edges of the reinforcing layers 22, 24 for example by welding or by vapor deposition.

In the area of the outer wall 14, the diffusion barrier layer 26 is therefore directly bonded thereto, in which area the reinforcing layers 22, 24 are not bonded with the outer wall 14. The outer wall is therefore completely covered by the reinforcing layers 22, 24 and the diffusion barrier layer 26.

The diffusion barrier layer 26 provides a diffusion-proof bonding of the first reinforcing layer 22 with the second reinforcing layer 24. Simultaneously, the diffusion barrier layer 26 serves to thermally isolate the first reinforcing layer 22 from the second reinforcing layer 24. The heat conduction through the diffusion barrier layer 26 is less than the heat conduction through the reinforcing layers 22, 24. The thermal conductivity, i.e. the thermal conductivity value, depends on the geometry and the specific thermal conductivity of a component. The diffusion barrier layer 26 is formed such that the product of the third thickness d3 and the specific third thermal conductivity $\lambda_3$ of the diffusion barrier layer 26 is smaller than both the product of the first thickness d1 with the first specific thermal conductivity $\lambda_1$ of the first reinforcing layer 22, as well as the product of the second thickness d2 with the second specific thermal conductivity $\lambda_2$ of the second reinforcing layer 24. This condition does not exclude the fact that the third specific thermal conductivity $\lambda_3$ or the third thickness d3 is greater than the corresponding sizes of the reinforcing layers 22, 24, since the size of the product can be corrected by the other, correspondingly reduced, factor. For example, by using a very thin, e.g. vapor-deposited, diffusion barrier layer 26 made of aluminium, which has a very high third specific thermal conductivity $\lambda_3$, with a very small third thickness d3 (by vapor deposition), a both insulating and diffusion-proof bonding between the reinforcing layers 22, 24 will be formed, wherein the above relationship of the products to one another is satisfied.

The spacer profile 1 therefore has a diffusion-proof diffusion barrier 27, which is formed from the first reinforcing layer 22, the diffusion barrier layer 26 and the second reinforcing layer 24 and extends from the first side wall 16 over the outer wall 14 to the second side wall 18. Therefore, the space 53 between the panes may be delimited in a diffusion-proof manner by the spacer profile 1 in the installed state of the spacer profile 1.

In the illustrated embodiment, the side walls 16, 18 each further have a notch 32 on the inner side of each side wall 16, 18 that faces towards the chamber. The notches 32 are formed below the center line in the height direction Y of the spacer profile 1 and extend in the longitudinal direction Z. The notches 32 provide an improved bending property, as will be further explained below.

Openings 34 are formed in the inner wall 12 so that, independent of the choice of material for the hollow profile body 10, the inner wall 12 is not formed in a diffusion-proof manner. In the assembled state, gas exchange, in particular also moisture exchange, between the space 53 between the panes and the chamber 20 filled with hygroscopic material can be ensured through the openings 34 of the spacer profile 1.

The inner wall 12 is referred to as the inner wall, since it is turned inwardly towards a space 53 between the panes (see FIGS. 1*a*) and *b*)) in the installed state. The outer wall 14 is referred to as the outer wall, since it faces away from the space 53 between the panes in the installed state. The side walls 16, 18 are formed as attachment crosspieces for attachment to the inner sides of the panes 51, 52, over which the spacer profile 1 is preferably adhered to the inner sides of the panes (see also FIG. 1). The chamber 20 is formed to accommodate hygroscopic material.

Figure 2:
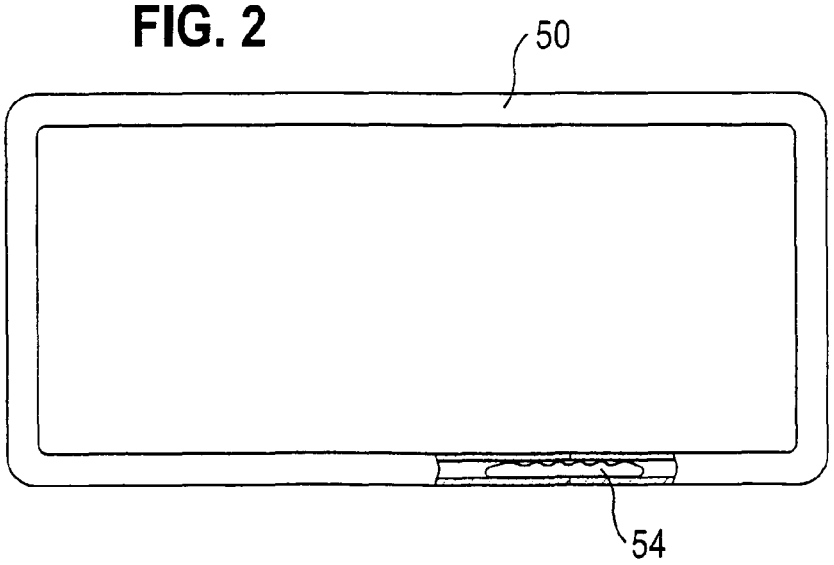

The spacer profile 1 is preferably bent by four 90° bends into a one-piece spacer frame 50 (see FIG. 2). Alternatively, one, two or three bends may be provided if necessary and the remaining, if provided, 90° corners are formed from corner connectors. The spacer profiles 1 are preferably bent in a cold bending process. For example, the spacer profile 1 is inserted into a groove during the bending, which groove guides and/or supports the side walls in the transverse direction X. This ensures that the side walls cannot outwardly spread in the transverse direction X during the bending.

During the bending of the spacer profile 1, the inner wall 12 is normally compressed and/or shortened. The outer wall 14 is stretched. Between the inner wall 12 and the outer wall 14 there is a neutral zone, in which the material of the body is neither stretched nor compressed. The neutral zone is also called "neutral line" of a body.

The curved design of the outer wall 14 ensures that the outer wall 14 "folds in" (see FIG. 15) towards the interior when the spacer profile 1 is bent. Herein, "folds in" means that the outer wall 14 is displaced towards the chamber 20, i.e. towards the neutral line. In addition, the notches 32 in the side walls 16, 18 make sure that the outer wall 14 can easily and amply fold inwardly during the bending of the spacer profile 1.

In order for the diffusion barrier layer 26 not to tear during the bending due to the usual stretching that occurs on the outer side of a bent body, the central section 25, which extends over the first distance a1 (area of the outer wall 14 on which no reinforcing layer 22, 24 is formed) in the transverse direction X, the arch 21 of the outer wall 14, i.e. the second height h2, the first and second wall thickness d1, d2 of the reinforcing layers 22, 24, the wall thicknesses s1, s2 of the chamber 20 and the notches 32, in particular, are formed such that, during the process of bending by 90° about the bending axis parallel to the transverse direction X, the diffusion barrier layer 26 is located substantially on the "neutral line" of the spacer profile 1. That is, the diffusion barrier layer 26 is not stretched during bending, since the diffusion barrier layer 26 is on the neutral line of the spacer profile 1. The bending tension is approximately zero there. The diffusion barrier layer 26 is therefore only required to fulfil very simple mechanical requirements and it can be ensured that the diffusion barrier layer 26 does not break and thus spring a leak during bending. The reinforcing layers 22, 24, in particular their thicknesses d1, d2, are formed so that they do not tear during the bending of the spacer profile 10. The diffusion barrier 27, which is made of the first reinforcing layer 22, the diffusion barrier layer 26 and the second reinforcing layer 24, therefore remains diffusion-proof even after the bending procedure.

The arched configuration also helps provide an "easy" folding-in for the inside wall 12. The inner wall 12 is mostly compressed. Alternatively or additionally, wrinkle formation may also occur, so that the length is shortened in a corresponding manner. The extension segments 28 reduce the wrinkle formation at the edges in the transverse direction X.

The plastic material of the hollow profile body 10 is preferably an elastically-plastically deformable, poorly heat-conductive (insulating) material.

Herein, the term "elastically-plastically deformable" preferably means that elastic restoring forces are active in the material after the bending process, as is typically the case for plastics, but that a portion of the bending occurs through a plastic, irreversible deformation. Further, the term "poorly heat-conductive" herein preferably means that the specific thermal conductivity $\lambda$ is less than or equal to 0.3 W/(mK).

Polyolefins, more preferably polypropylene, polyethylene terephthalate, polyamide, copolyamide or polycarbonate, ABS, SAN, PCABS, are preferably such a material. An example of such a polypropylene is Novolen 1040®. The material preferably has an elastic modulus less than or equal 2200 N/mm$^2$ and a specific thermal conductivity $\lambda \leq 0.3$ W/(mK), preferably $\leq 0.2$ W/(mK).

The first metallic material is preferably a plastically deformable material. Herein, the term "plastically deformable" means that practically no elastic restoring forces are acting after the deformation. This is typically the case when metals are bent beyond the yield point. The preferred first metallic material for the reinforcing layer 22 is steel or stainless steel and has a first specific thermal conductivity in the range of 10 W/(mK)$\leq \lambda_1 \leq$50 W/(mK), preferably in the range of 10 W/(mK)$\leq \lambda_1 \leq$25 W/(mK), and more preferably in the range of 14 W/(mK)$\leq \lambda_1 \leq$17 W/(mK). The elastic modulus of this material is preferably in the range of 170 to 240 kN/mm2 kN/mm$^2$, preferably at 210 kN/mm$^2$. The elongation at break of the material is preferably $\leq$15%, more preferably $\leq$20%, even more preferably $\leq$30% and even more preferably $\leq$40%. The metallic material can have an anti-corrosion coating made of tin (such as tin plate) or zinc, if necessary, if required or desired, with a chromium coating or chromate coating. The second metallic material of the second reinforcing layer 24 preferably corresponds to the first metallic material, but it may, in particular if the shapes and thicknesses/widths of the two reinforcing layers 22, 24 differ from one another, also be a metallic material that differs from the first metallic material. An example of a reinforcing layer 22, 24 is a stainless steel foil having a thickness d1, d2 of 0.10 mm.

The diffusion-proof, preferred metallic material for the diffusion barrier layer 26 is, for example steel or stainless steel, vapor-deposited aluminium or sputtered aluminium. Alternatively, the diffusion barrier layer also may be formed from a diffusion-proof multilayer plastic film having a metallic coating or a metallic layer transfer foil. This means that the diffusion barrier layer 26 may be formed of plastic with an embedded, continuous metal layer.

The metallic material for the diffusion barrier layer 26 has a specific third thermal conductivity in the range of 10 W/(mK)$\leq \lambda_3 \leq$250 W/(mK), and preferably in the range of 14 W/(mK) (stainless steel)$\leq \lambda_3 \leq$200 W/(mK) (aluminium). An example of a diffusion barrier layer 26 made of metal is for example a stainless steel foil having a thickness d3 of 0.01 mm, an aluminium foil having a thickness d3 of 0.001 mm to 0.01 mm, or a vapor-deposited or sputtered aluminium layer having a thickness d3 of less than 10 nm. It should be noted that thickness d3 indicates only the thickness of the metal layer. In case of a diffusion barrier layer made of plastic with an embedded metal layer or a multilayer foil, the diffusion barrier layer is correspondingly thicker.

For the manufacture of the spacer 1, the hollow profile body 10 is preferably coextruded together with the first and second reinforcing layer 22, 24. After the extrusion process, the first and second reinforcing layer 22, 24 are bonded directly to the hollow profile body 10 in a molecular bonded manner. The first and second reinforcing layer 22, 24 are spaced from one another by the first distance a1 in the transverse direction X on the outer side of the outer wall 14. In a further step the diffusion barrier layer 26 is applied in a diffusion-proof manner onto the central section 25 over the first distance a1 on the outer side of the outer wall 14 that is not bonded to the reinforcing layer 22, 24. For example, the diffusion barrier layer 26 is vapor-deposited, adhered, sputtered, laminated or galvanized. The diffusion barrier layer 26 is thereby bonded in a diffusion-proof manner at its edges in the transverse direction X with the respective reinforcing layer 22, 24. After application of the diffusion barrier layer 26, the first reinforcing layer 22, the diffusion barrier layer 26 and the second reinforcing layer 24 form a continuous diffusion barrier 27.

After the manufacture of the spacer profile 1, it is bent in accordance with the shape of the desired spacer frame 50, as shown in FIG. 2 in an exemplarily manner. During the bending, as was already described above, the side walls 16, 18 are preferably guided so that they can not spread in the transverse direction X due to the bending process. After the bending of the spacer frame 50, the ends must be connected using a suitable connector 54 (see FIG. 2). After the connection of the spacer profile 1, the side walls 16, 18, which are formed as attachment crosspieces, are adhered using an adhesive material (primary sealant) 61, e.g. a butyl sealant based on polyisobutylene, to the pane inner sides of the panes 51, 52 (see FIG. 1). The space 53 between the panes is thus delimited by two panes 51, 52 and the spacer frame 50. The inner side of the spacer frame 50 faces towards the space 53 between the panes. On the side facing away from the space 53 between the panes in the height direction Y in FIG. 1, a mechanically stabilizing sealing material (secondary adhesive), e.g. polysulphide, polyurethane or silicone, is introduced into the remaining empty space between the pane inner sides to fill the empty space. This sealing material also protects the diffusion barrier 27 from mechanical and other corrosive/deteriorating influences. The thus manufactured insulating pane unit can then be installed in a window frame.

All description relating to the first embodiment also applies to all other described embodiments, unless a difference is expressly described or shown in the Figures.

Figure 3B:
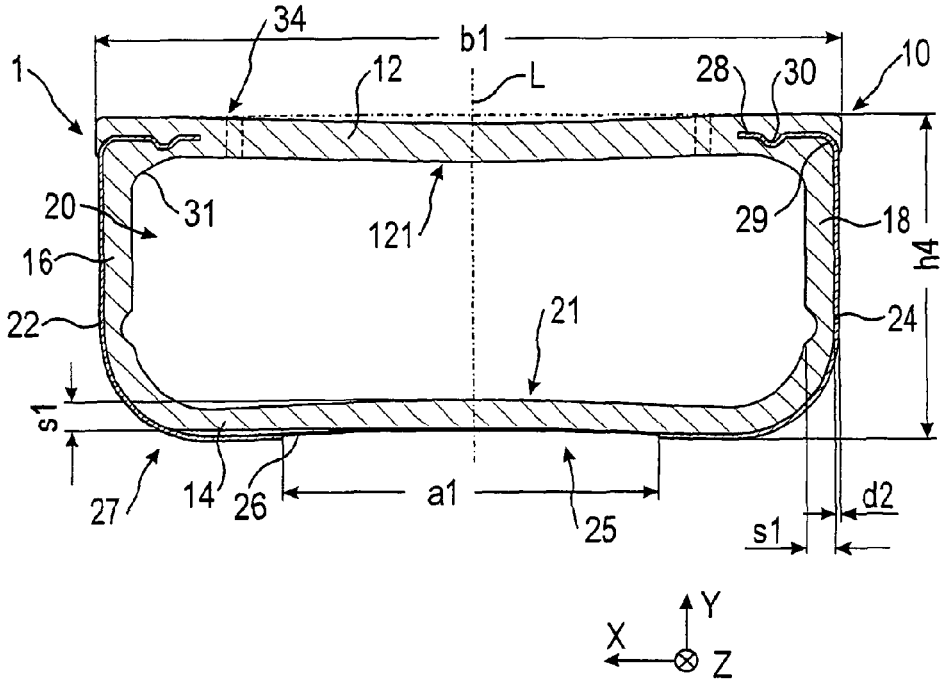

FIG. 3*b*) shows a spacer profile 1 according to a second embodiment. The only difference from the spacer profile 1 according to the first embodiment is that the reinforcing layers 22, 24 are formed such that the first distance a1 between the reinforcing layers 22 and 24 is larger in the transverse direction X than that of the embodiment shown in FIG. 3*a*). This means that the first reinforcing layer 22 and the second reinforcing layer 24 are formed in essence only up to the edge regions of the outer wall 14 in the transverse direction X and the diffusion barrier layer 26 extends over the larger, in comparison to the first embodiment, first distance a1 in the transverse direction X. In essence, the diffusion barrier layer 26 lies completely, according to the previous embodiments, on the neutral line of the spacer profile 1.

Figure 4A:
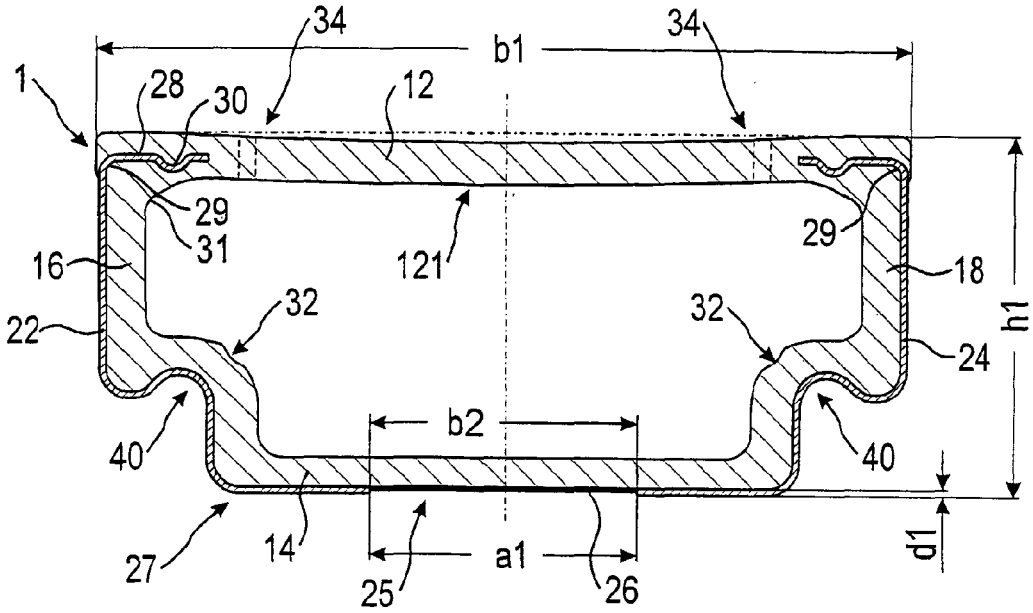
Figure 4B:
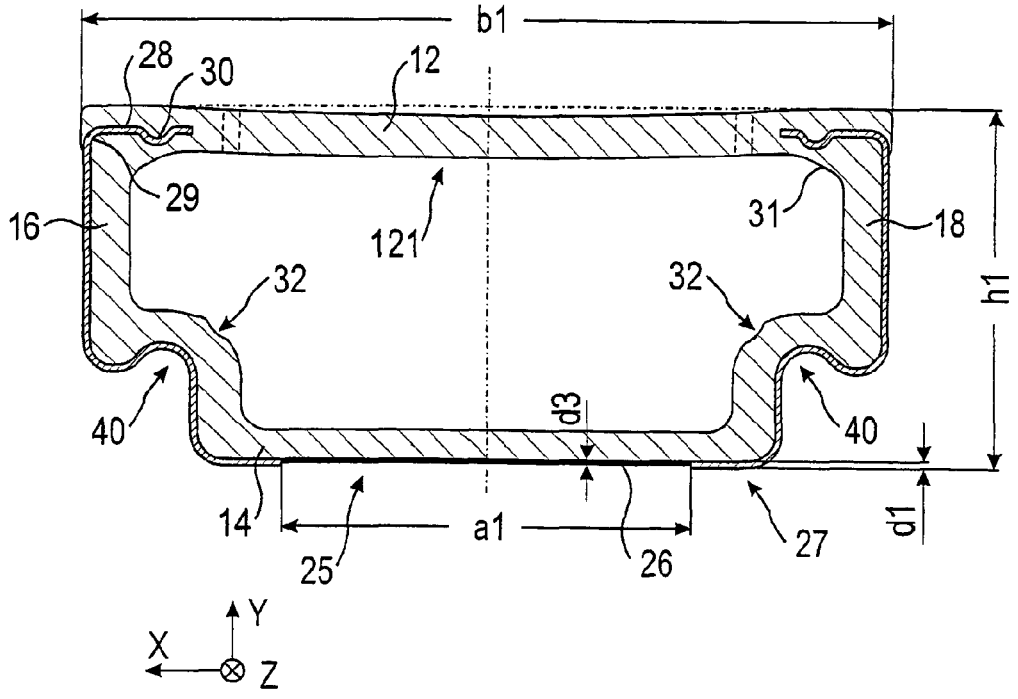
Figure 5:
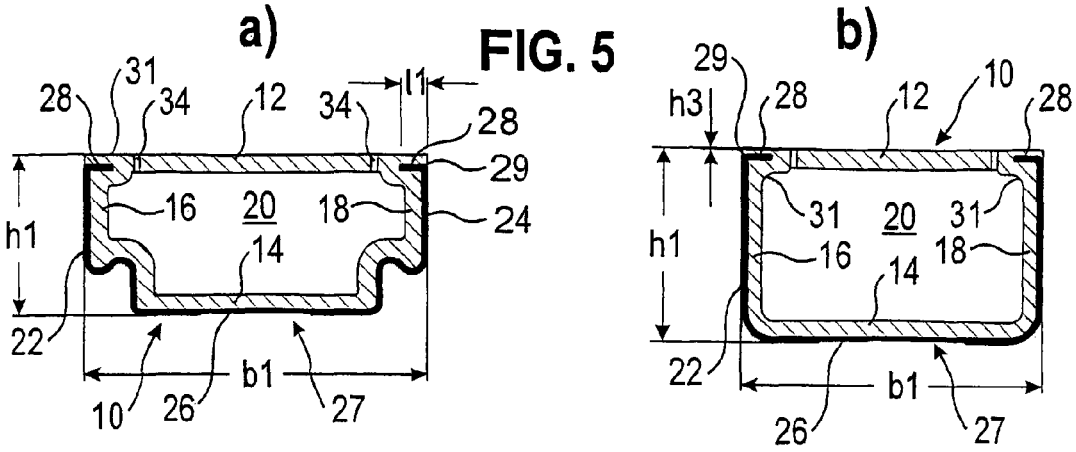
Figure 6:
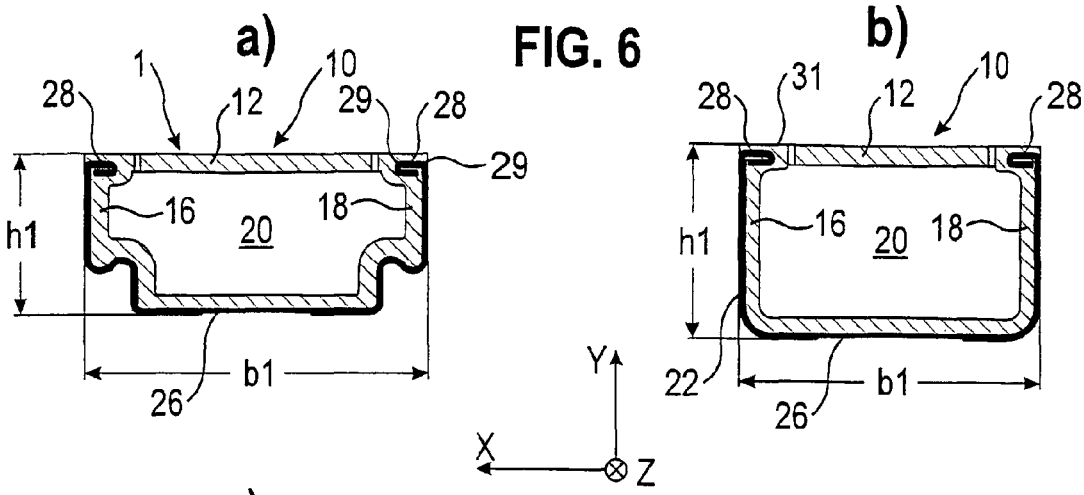

FIG. 4*a*) shows a spacer profile 1 according to a third embodiment. The spacer profile 1 according to the third embodiment is formed in a so-called "W-configuration". In the W-configuration, the side walls 16 each have, as viewed from within the chamber 20, a concave connecting portion 40 to the outer wall 14. Since the reinforcing layers 22, 24 on the outer side of the side walls 16, 18 extend up to the outer side of the outer wall 14, the reinforcing layers 22, 24 have a corresponding concave connecting portion 40. The concave connecting portion 40 results in an elongation of the reinforcing layers 22, 24 for the same first width b1 and first height h1 of spacer profile 1. Through the elongated reinforcing layers 22, 24, the heat conduction is reduced through the reinforcing layers 22, 24 relative to the first embodiment (U-configuration) despite the same height h1 and width b1. In addition, the bending stiffness of the spacer profile 1 is further improved due to the modified structure. As a result of the concave connecting portions 40, the arch 21 in the outer wall 14 may not be necessary. During the bending, the area, which includes the diffusion barrier layer 26, folds inwardly towards the chamber 20. The area, which includes the diffusion barrier layer 26, lies on the neutral line of the spacer.

The rest of the spacer profile 1 corresponds to what is shown in FIG. 3*a*). The fourth embodiment shown in FIG. 4*b*) differs from the embodiment shown in FIG. 4*a*) in that the first distance a1 is increased relative to the embodiment shown in FIG. 4*a*). The thermal conduction can be further reduced thereby.

The hereinafter-described fifth to twelfth embodiments each include, in particular, a diffusion-proof diffusion barrier 27, which is formed from the first reinforcing layer 22, the diffusion barrier layer 26 and the second reinforcing layer 24. Further, in all illustrated embodiments, the diffusion barrier layer 26 lies on the neutral line of spacer profile 1 during the bending about an axis parallel to the transverse direction X1. In the spacer profiles shown in FIGS. 5 to 14, none of the optional notches 32 and arches 21, 121 are shown for simplicity.

In the fifth embodiment shown in FIGS. 5*a*) and *b*), the extension segment 28 has a bend 29 of 90° corresponding to the first and second embodiments and an adjoining segment (flange), which extends inwardly from the outer edge of the corresponding side wall 16, 18 over a length l1 in the transverse direction X. Unlike the first embodiment, the extension segment 28 has no additional profiling in the shape of a groove extending in the longitudinal direction Z, but rather it extends straight.

In FIGS. 6*a*) and *b*), a spacer profile 1 according to a sixth embodiment is shown in cross section in the X-Y plane. The sixth embodiment differs from the fifth embodiment in that the extension segments 28 are almost twice as long as in the first embodiment, wherein the extension length l1 in the transverse direction X remains almost the same. This is achieved by the fact that the extension segments 28 have a second bend 29 of 180°. The second bend 29 of 180° is formed at the distance l1 from the outer side of the corresponding side wall 16, 18 so that the segment of the extension segment 28, which adjoins the second bend 29, also extends in the transverse direction X, but outwardly. This ensures that a much longer extension segment is disposed in the inner wall 12 of the spacer profile 1, whereby improved bending properties result. In addition, a portion of the material of the hollow profile body 10 is thereby enclosed on three sides by the profiles formed by the extension segments 28. This enclosure results in that, under compression, the enclosed material acts like a substantially non-compressible volume element during a bending process. An improved bending property and/or stiffness property results therefrom.

Figure 7:
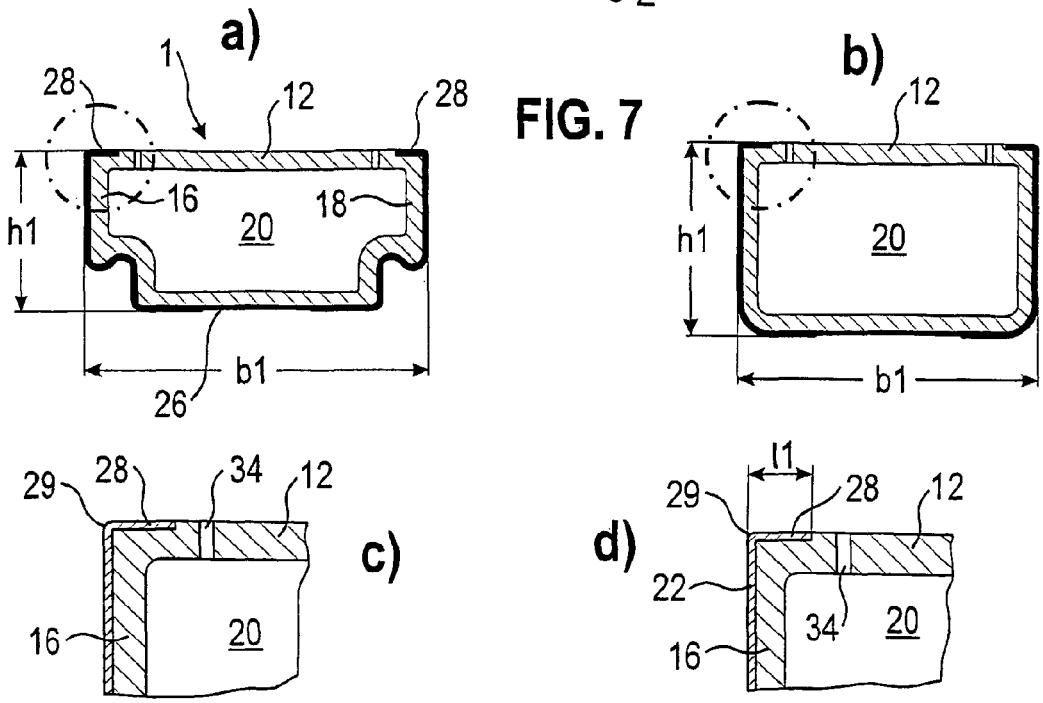
Figure 8:
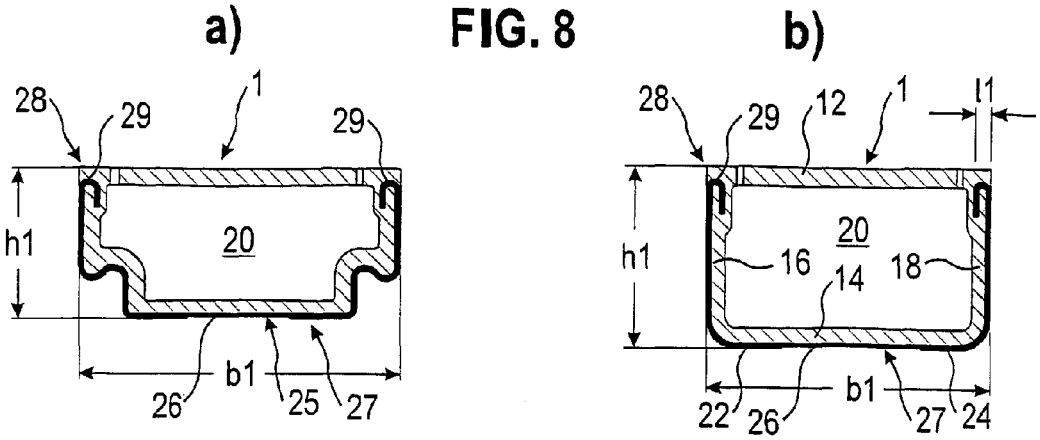
Figure 9:
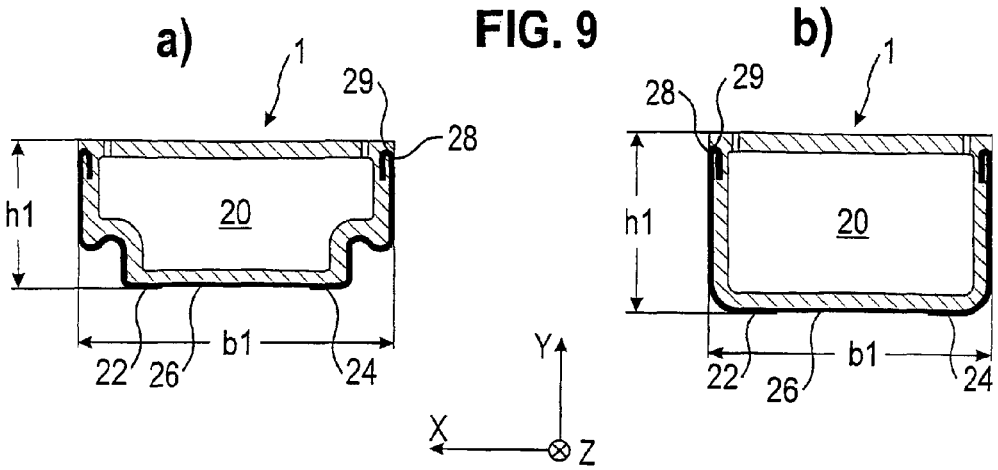
Figure 10:
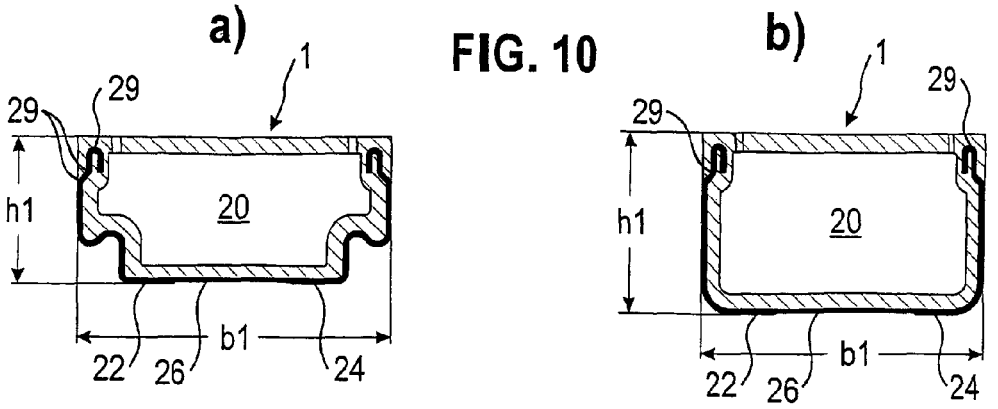
Figure 11:
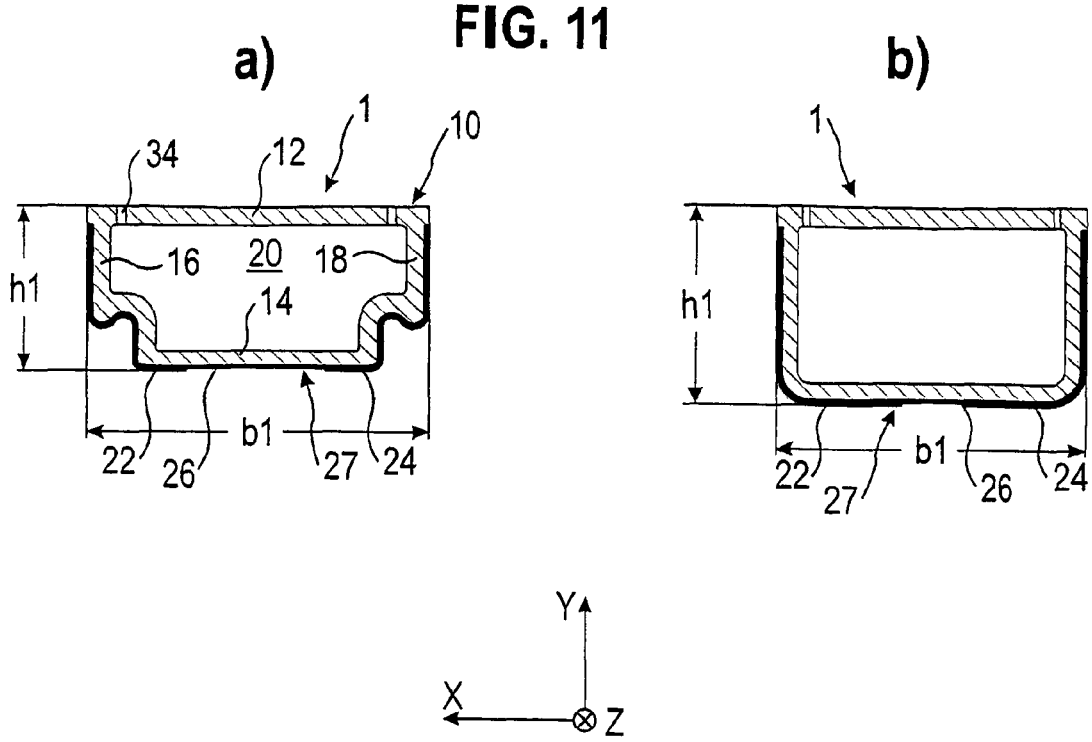
Figure 12:
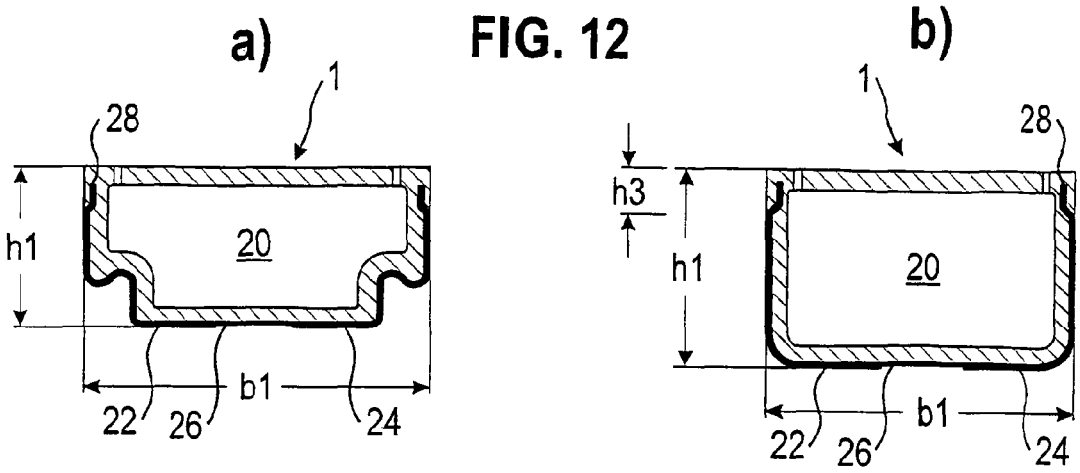

Referring to FIGS. 7*a*) and *b*), a spacer profile 1 according to a seventh embodiment will be described, wherein in FIGS. 7*c*) and *d*) the areas surrounded by a circle in a) or b) are shown enlarged. In the embodiment shown in FIG. 7 the extension segments 28 do not protrude into the inner wall 12, but are provided on the outer side of the inner wall 12. The extension segments 28 are visible in a very advantageous position for bending property, certainly by a consumer when installed.

FIGS. 8*a*) and *b*) are cross sectional views of a spacer profile 1 according to an eighth embodiment. The eighth embodiment differs from the fifth embodiment in that the bend 29 is not a 90° bend, but rather a 180° bend, so that the part of the extension segment 28 that follows the bend 29 extends in the height direction Y. According to the sixth embodiment, a three-sided enclosure of a portion of the material of the hollow profile body 10 is thereby achieved, even though only one bend 29 is present. This leads to an improved bending property and stiffness property.

In FIGS. 9*a*) and *b*), cross sectional views of a spacer profile 1 according to a ninth embodiment are shown. The ninth embodiment differs from the eighth embodiment only in that the radius of curvature of the extension segments 28 is smaller than the radius of curvature of the eighth embodiment.

In FIGS. 10*a*) and *b*), cross sectional views of a spacer profile 1 according to a tenth embodiment are shown. The tenth embodiment differs from the first through ninth embodiments in that the extension segments 28 first make a bend 29 of approximately 45° inwards and then have a bend 29 of approximately 45° in the opposite direction and then a bend 29 of 180° with the corresponding three-sided enclosure of a portion of the material of the hollow profile body 10.

If the spacer profile 1 or the extension segment 28 have curved and/or angled configurations corresponding to FIGS. 3 to 10, the length (in the cross section perpendicular to the longitudinal direction) of the extension segment 28, and thus the mass of the reinforcing layer additionally introduced in this segment or portion of the spacer profile, can be significantly increased. A reduced wrinkle formation during the bending thereby results. Further, sagging is considerably reduced, since the curved, angled and/or folded extension segment significantly contributes to strengthening the structural integrity of the bent spacer frame.

FIGS. 11*a*) and *b*) show a spacer profile 1 according to an eleventh embodiment in a W- and a U-configuration. The spacer profile 1 of this embodiment has no extension segments 28.

FIGS. 12*a*) and *b*) show a spacer profile 1 according to a twelfth embodiment. This spacer profile 1 differs from the tenth embodiment shown in FIGS. 10 *a*) and *b*) in that the 180°-bend 29 and the adjoining part of the extension segment 28 are not present.

Figure 13:
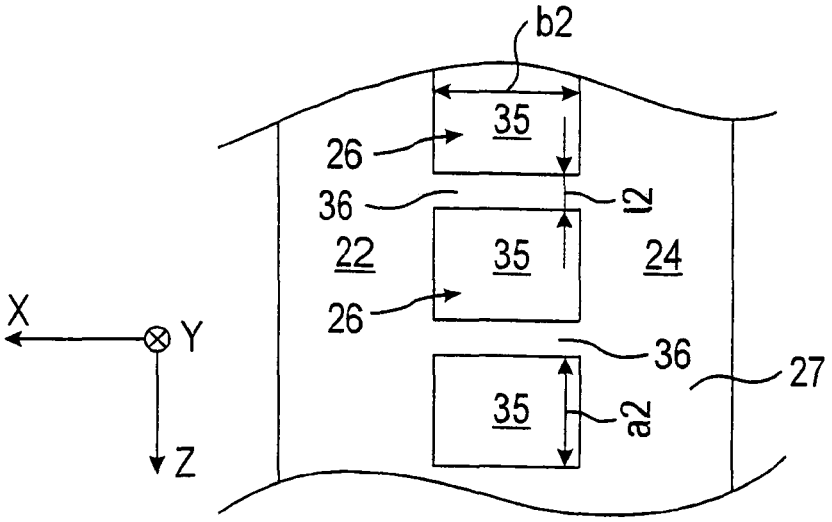

In FIG. 13, a further alternative embodiment is shown in a view, as seen in the Y direction from below. In this embodiment there is only one reinforcing layer 22, 24 extending on the side walls 16, 18 and the outer wall 14. The reinforcing layer 22, 24 has openings 35 that are separated by transverse crosspieces 36. Each opening is formed centrally between the side walls 16, 18 and has the second width b2 in the transverse direction X. The height of the openings in the longitudinal direction Z results from a second distance a2 of the transverse crosspieces 36 relative to one another. The transverse crosspieces 36 themselves extend with a second length 12 in the longitudinal direction Z. The transverse crosspieces 36 and the openings 35 are preferably disposed at regular intervals in the longitudinal direction Z. In the area of the transverse crosspieces 36, the reinforcing layer 22, 24 can have a different thickness/width in height direction Y. The diffusion barrier layer 26 is applied between the transverse crosspieces 36 and the reinforcing layer 22, 24 at least on the areas not covered by reinforcing layers 22, 24 of the outer wall 14. The diffusion barrier layer can be also applied on the transverse crosspieces 36 to simplify the manufacture. In such an embodiment, the upper load limit in the transverse direction X, and the compressive-/tensile force that the spacer profile can withstand in the transverse direction X without deforming or breaking, can be increased. Furthermore, it can be easily ensured that the diffusion barrier layer 26 lies in the neutral line.

Figure 14:
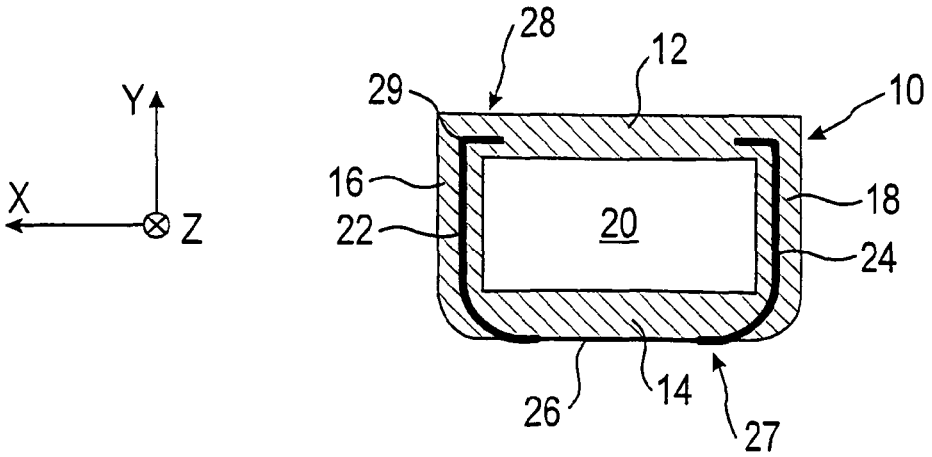

FIG. 14 shows a further embodiment that does not have all claimed features, in which the reinforcing layers 22, 24 are fully incorporated in the side walls 16, 18 and partially in the outer wall 14.

Figure 17:
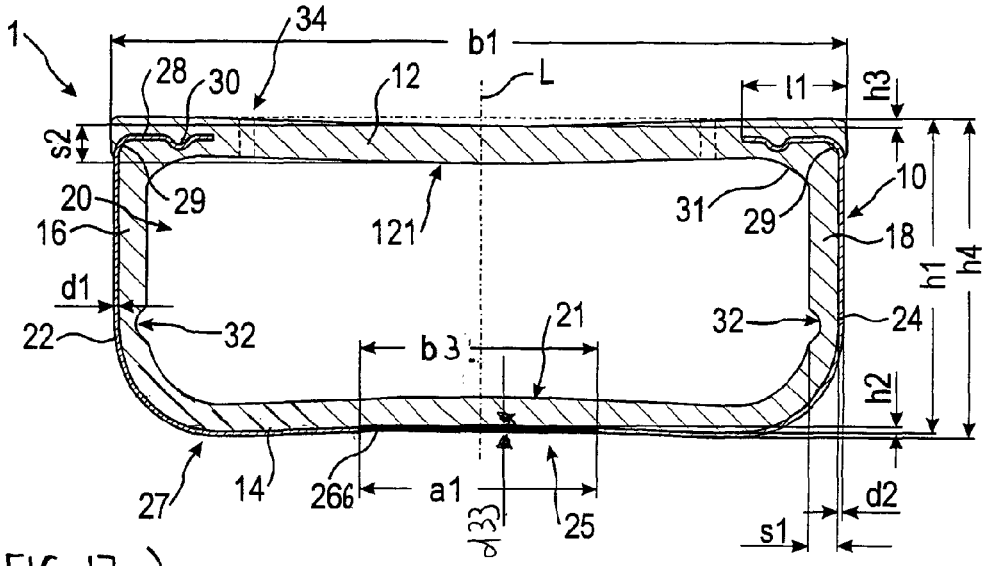

FIG. 17 shows in a) to d) the fifteenth to nineteenth embodiment. In these embodiments, the diffusion barrier layer 266 is not formed of a metallic material, but rather only of a plastic material. The plastic material is diffusion-proof. Such a diffusion-proof plastic material is for example an ethylene-vinyl alcohol-copolymer, which is also referred to as EVOH. Such an EVOH material preferably has a third specific thermal conductivity $\lambda_{33}$ between 0.25 W/(mK) and 0.40 W/(mK).

Because of this low third specific heat conductivity $\lambda_{33}$, the diffusion barrier layer 266 made of EVOH material can have greater third thickness d33 in comparison to the metallic material of preceding embodiments and at the same time making possible a high or higher thermal insulation. Here too, however, in order to achieve an improvement of the thermal insulation relative to a continuous reinforcing layer, the product of the third specific thermal conductivity $\lambda_{33}$ and the third thickness d33 must be smaller than the product of the first specific thermal conductivity $\lambda_1$ and the first thickness d1 and smaller than the product of the second specific thermal conductivity $\lambda_2$ and the second thickness d2.

The EVOH material distributed by NIPPON GOHSEI, under the product name "SoarnoL®", is preferably used. This product is offered with various ethylene contents. For example, "SoarnoL® V" (25 mol % ethylene) "SoarnoL® DC" (32 mol % ethylene) "SoarnoL® ET" (38 mol % ethylene), "SoarnoL® AT" (44 mol % ethylene) or "SoarnoL® H" (48 mol % ethylene) may be used. More preferably, the material sold under the product name "SoarnoL® 29 mol %" or "SoarnoL® DT" or "SoarnoL® D" with 29 mol % ethylene is used.

Such a "SoarnoL® 29 mol %" or "SoarnoL® DT" or "SoarnoL® D" has a specific third thermal conductivity $\lambda_{33}$=0.33 W/(mK) at 60° C. and =0.28 W/(mK) at 120° C. In the fifteenth to nineteenth embodiment, the third thickness d33 of the diffusion barrier layer 266 made of EVOH material is substantially greater than the third thickness d3 of the diffusion barrier layer 26 made of metallic material in the first to fourteenth embodiments. Because of the greater thickness d33, the diffusion barrier layer 266 is much more resistant (stretch-resistant, tear-resistant) than the very thin metal layer/foil used in the above embodiments. Thus, in the fifteenth to nineteenth embodiment it is not absolutely necessary to form the spacer profile 1 such that during the bending of the spacer profile 1 the diffusion barrier layer 266 lies on the neutral line of the spacer profile 1. For this reason, the arches 21, 121 and notches 32 are optional features.

If the diffusion barrier layer 266 is formed with a very small third thickness d33 of 0.01 mm to 0.1 mm in accordance with the first to fourteenth embodiments, it is preferable that the spacer profile 1 according to the first to fourteenth embodiments is also formed such that, during the bending of the spacer profile 1, the diffusion barrier layer 266 made of EVOH material lies in the neutral line.

As above, the diffusion barrier layers 266 in the fifteenth to nineteenth embodiment extend in the longitudinal direction Z with a constant cross-sectional shape in an X-Y section perpendicular to the longitudinal direction Z along the entire length of the spacer profile and are arranged symmetrically to the symmetry plane L.

In the fifteenth embodiment shown in FIG. 17*a*), the diffusion barrier layer 266 extends in the transverse direction X with a third width b3 over the first distance a1 between the first reinforcing layer 22 and the second reinforcing layer 24. The diffusion barrier layer 266 has a third thickness d33 in this embodiment. In these embodiments, the third thickness d33 preferably corresponds to the first thickness d1 of the first reinforcing layer 22 or to the second thickness d2 of the second reinforcing layers 22, 24, which here are equal (d1=d2).

The diffusion barrier layer 266 is directly bonded in a diffusion-proof manner to the outer wall 14, for example by co-extrusion, lamination or by using an adhesion agent. Preferably, the diffusion barrier layer 266 and the outer wall 14 are bonded in a molecular bonded manner. According to the first to fourteenth embodiment, the diffusion barrier layer 266 is also diffusion-proof, preferably in a molecular bonded manner, bonded at its edges in the transverse direction X in each case with the first and second reinforcing layer 22, 24, for example by using an adhesive agent or by welding. Also in this embodiment a continuous diffusion barrier 27 is formed by the reinforcing layers 22, 24 and the diffusion barrier layer 266. A substantially continuous plane is created by the diffusion barrier layer 266 and the reinforcing layers 22, 24.

Figure 17B:
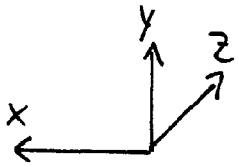
Figure 17B:
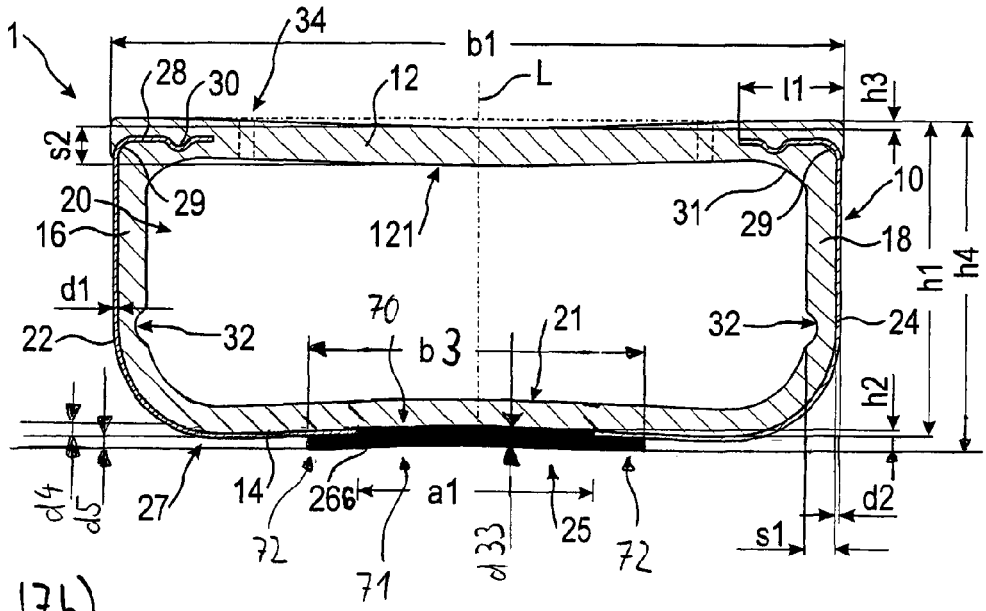

In the sixteenth embodiment shown in FIG. 17*b*), the diffusion barrier layer 266 is formed and/or applied on the outer wall 14 in a "pedestal-like" or in an inverse "T-shape" manner in an intermediate space between the reinforcing layers 22, 24. The intermediate space extends between the reinforcing layers 22, 24 and is delimited on the outer wall in the transverse direction X on both sides by the edges of the reinforcing layers 22, 24 that face each other in the transverse direction X. In the height direction Y the intermediate space is delimited on one side by the outer side of the outer wall 14 that faces away from the inner wall 12.

The diffusion barrier layer 266 has a first area 70 and a second area 71. The first area 70 corresponds to the diffusion barrier layer 266 of the sixteenth embodiment. As above, the width of the first area 70 corresponds to the first distance a1 between the reinforcing layers 22, 24. A fourth thickness d4 of the first area 70 in the height direction Y preferably corresponds to thickness d1, d2 of the reinforcing layers 22, 24

In the height direction Y on the side facing away from the outer wall 14, the second area 71 is formed adjoining to the first area and extends over a third width b3, which is greater than the first distance a1 between the reinforcing layers 22, 24. The second section 71 is formed so as to overlap with the reinforcing layers 22, 24 over a width (b3−a1)/2 on each side. The second area 71 has a fifth thickness d5. The first area 70 and the second area 71 are integrally formed.

In the area between the reinforcing layers 22, 24, the diffusion barrier layer 266 has a total thickness d33=d4+d5, which is greater than the thickness d1 and/or d2 of the reinforcing layers. The diffusion barrier layer 266 can be coextruded together with the hollow profile body 10 and the reinforcing layers 22, 24. Alternatively, they can be bonded, preferably in a diffusion-proof manner, even after application of the reinforcing layers 22, 24 for example by using an adhesive agent or by laminating with the reinforcing layers 22, 24 and/or with the outer wall 14.

The total height h4 of the spacer profile is in this case (without regard to the optional arch 21) the sum of the first h1 of the hollow profile body 10 and the third thickness d33 of the diffusion barrier layer 266.

Figure 17C:
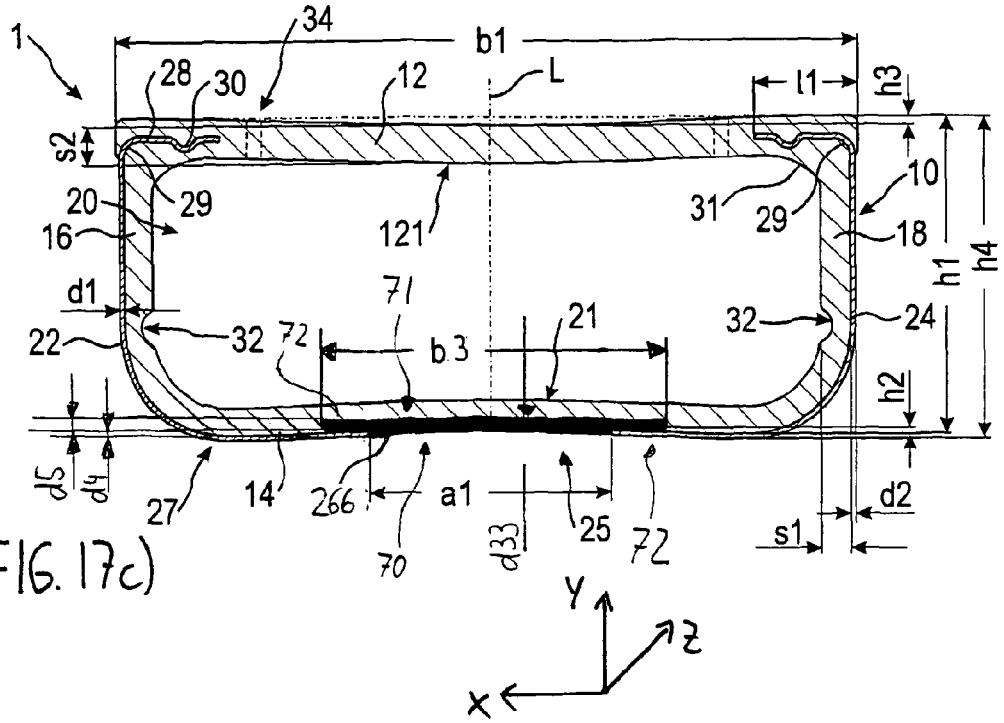

FIG. 17*c*) shows a seventeenth embodiment, which has a diffusion barrier layer 266 with a first area 70 like the sixteenth embodiment; the first area 70 is formed between the reinforcing layers 22, 24. In this embodiment, a second area 71 is not formed on the side facing away from the outer wall 14 of the reinforcing layers 22, 24, but rather is formed opposite, on the side facing the outer wall 14 of the first area 70. The diffusion barrier layer 266 therefore extends between the reinforcing layers 22, 24 and partly on the side of the reinforcing layers 22, 24 facing towards the inner wall 14, between the reinforcing layers 22, 24 and the outer wall 14. The widths in the transverse direction X and the thicknesses in the height direction Y of the first area 70 and of the second area 71 preferably correspond to those of the sixteenth embodiment. Thus the areas 72 overlapping with the reinforcing layers 22, 24 also have the dimensions of the sixteenth embodiment.

Since the fourth thickness d4 of the diffusion barrier layer 266 corresponds to the thickness d1, d2 of the reinforcing layers 22, 24, a substantially unbroken/continuous layer is formed by the diffusion barrier layer 266 and the reinforcing layer (disregarding the arch 21). The outer wall 14 has a reduced wall thickness (s1–d5) in the area, where the diffusion barrier layer 266 is formed. The second area 71 of the diffusion barrier layer 266 is preferably completely enclosed by the outer wall.

Figure 17D:
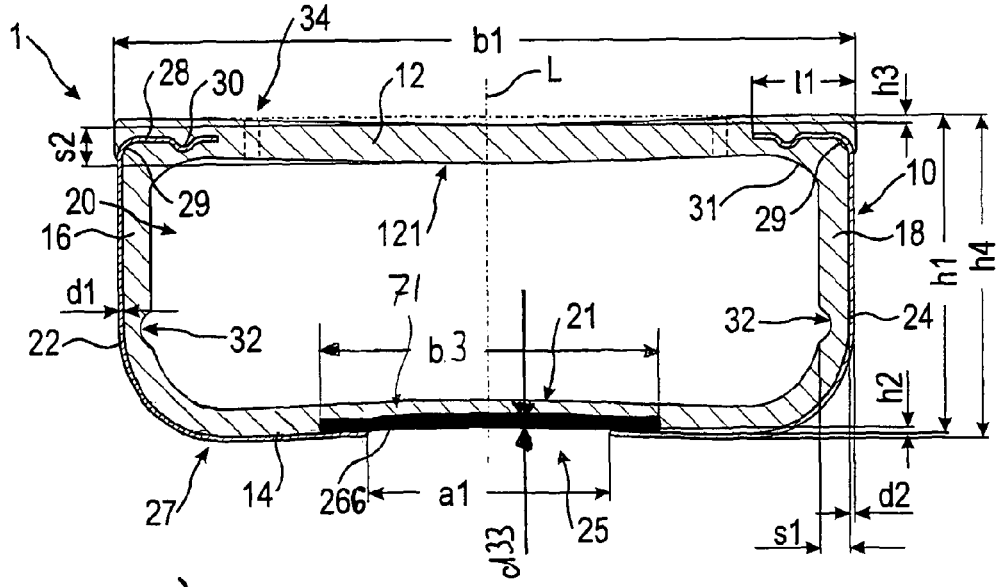

In the eighteenth embodiment shown in FIG. 17*d*), the diffusion barrier layer 266 substantially matches the second area 71 of the seventeenth embodiment. The diffusion barrier layer 266 has a third thickness d33 in the height direction Y and a third width b3 in the transverse direction X. The third width b3 is greater than the first distance a1. The diffusion barrier layer 266 has a rectangular cross-section as viewed in the X-Y plane, and is surrounded entirely by the outer wall 14. The outer wall 14 has, therefore, a smaller wall thickness (s1–d33) in the area between the reinforcing layers 22, 24.

The diffusion barrier layer 266 is symmetrically arranged around the symmetry axis L such that it is arranged between the reinforcing layers 22, 24 and the outer wall 14 over a width (b3–a1)/2 on each side, i.e. it overlaps with the reinforcing layers in the transverse direction X. The diffusion barrier layer 266 is not formed in the plane defined by the edges of the reinforcing layers 22, 24 in the transverse direction X (disregarding the arch 21), but rather abutting on this plane in the height direction Y towards the inner wall 12.

Figure 17E:
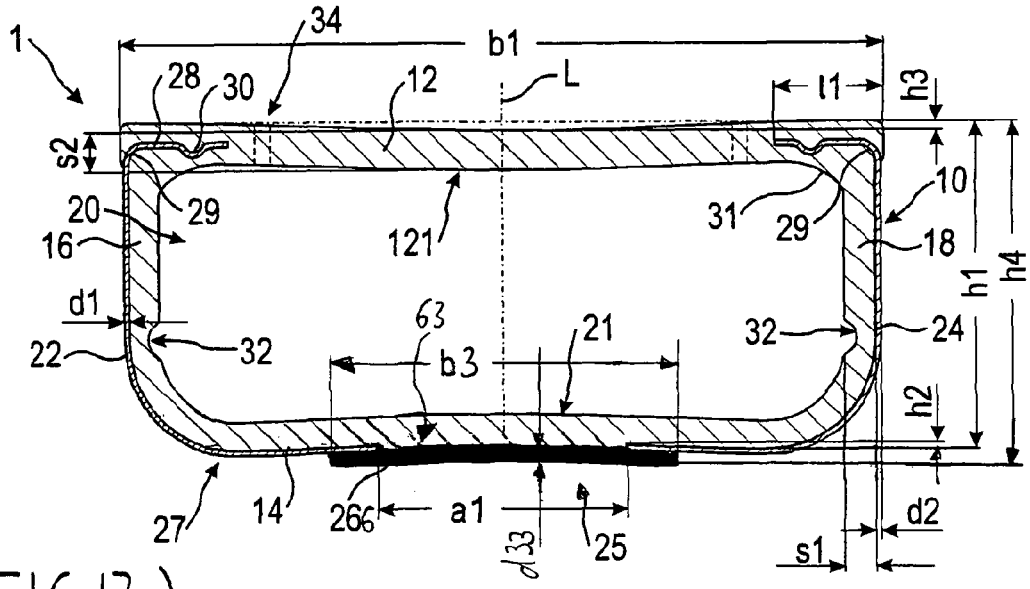

In the nineteenth embodiment shown in FIG. 17*e*), the diffusion barrier layer 266 is formed with a rectangular cross section, as viewed in the X-Y plane. The diffusion barrier layer has a third thickness d33 in the height direction Y and a third width b3 in the transverse direction X. The third width b3 is greater than the first distance a1.

In this embodiment, the wall thickness s1 of the outer wall 14 in the central section 25 between the reinforcing layers 22, 24 is greater on the side facing away from the inner wall 12 by the thickness d1 or d2. The outer wall 14 forms a continuous plane 63 with the reinforcing layer 22, 24 and incorporates the edges of the reinforcing layers 22, 24 in the transverse direction X.

The diffusion barrier layer 266 is applied and/or formed on this continuous plane 63 symmetrical to the symmetry plane L. The diffusion barrier layer 266 abuts both the reinforcing layers 22, 24 and the outer wall 14 in the area between the reinforcing layers 22, 24.

The diffusion barrier layers 266 shown in FIGS. 17*c*), 17*d*) and 17*e*) may be coextruded either with the hollow profile body 10, or together with the hollow profile body 10 and the reinforcing layers 22, 24. Alternatively, they could be attached before the attachment of the reinforcing layers 22, 24 to the outer wall 14 using an adhesion agent, by laminating, by welding, etc. (see also the first to fourteenth embodiment). Alternatively, they could also be attached after affixing the reinforcing layers 22, 24 for example by insertion and adhering. Preferably, at least the reinforcing layers 22, 24 and the diffusion barrier layer 266 are bonded to one another in a molecular bonded and diffusion-proof manner by co-extrusion, by applying adhesion agents (see above), to form a continuous diffusion barrier layer 27.

Figure 18:
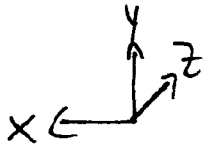
Figure 18:
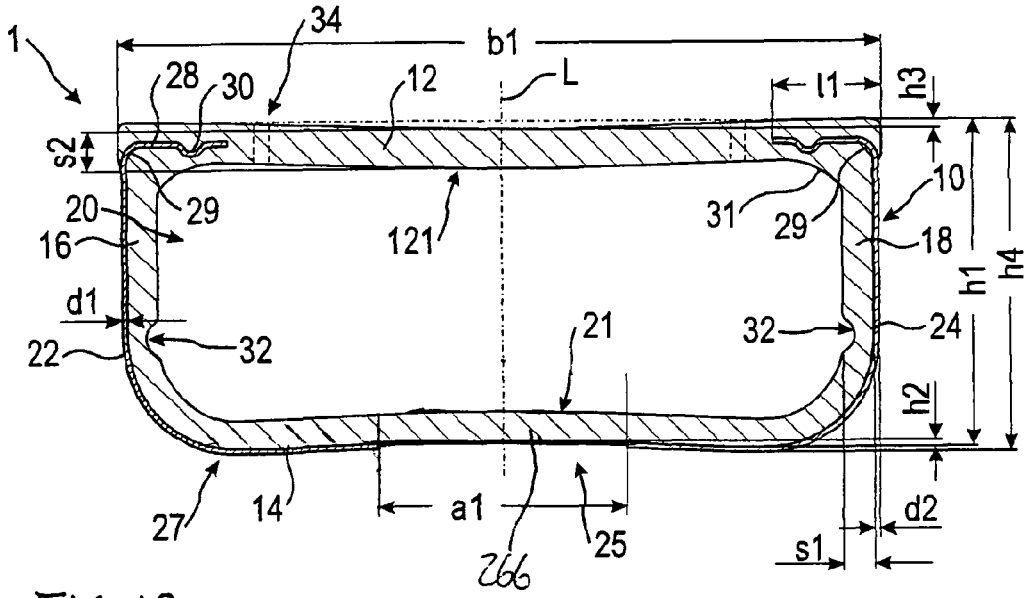

FIG. 18 shows a twentieth embodiment of this invention. In this embodiment, the entire hollow profile body 10 is formed from the diffusion-proof EVOH material. The diffusion barrier 27, which was always formed in the above embodiments by the reinforcing layers 22, 24 and the diffusion barrier layer 26, 266, is realized in this embodiment by the side walls 16, 18 and the outer wall 14. The diffusion barrier layer is integrally formed with the outer wall 14 in this embodiment.

Alternatively, only the side walls 16, 18 and the outer wall 14, or only the outer wall 14, also may be formed from the EVOH material. The wall thickness of each of the walls made of the EVOH material can be up to 2 mm, but it preferably should correspond to that of the first to fourteenth embodiments.

The diffusion impermeability of EVOH material can be adversely affected by contact with water and/or water vapor, especially in case of a thin EVOH material. EVOH material may tend to absorb water and/or water vapor. The diffusion impermeability can also be reduced by the absorption.

To avoid this negative effect, it has proved to be advantageous to form the diffusion barrier layer of at least two sheets or two layers. A two-layer diffusion barrier has a first layer made of EVOH material (first layer 74). The first layer made of EVOH material is applied to and/or formed on a support layer (second layer 75), which has a very low water permeability or is diffusion-proof with respect to water/water vapor. It can be particularly advantageous when the first layer made of EVOH material is protected from contact with water by the second layer. Particularly preferred is an arrangement, in which the first layer made of the EVOH material is protected from contact with water/water vapor by both the second layer and the outer wall 14 of hollow profile body. In this particularly advantageous embodiment, the first layer is therefore arranged between the outer wall 14 and the second layer.

In particular, a polyolefin, preferably PE and even more preferably PP, can be used as the material for the support layer.

Figure 19:
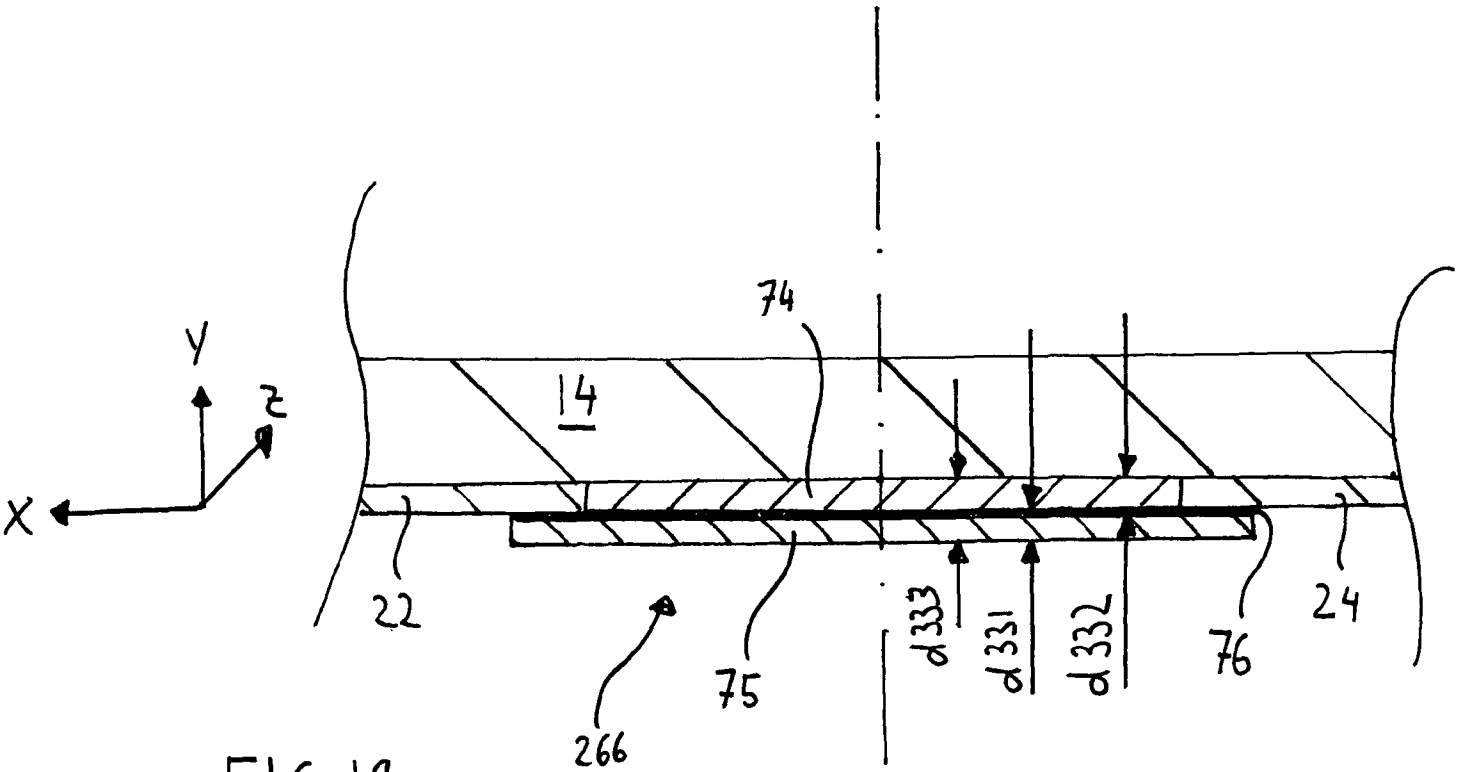

FIG. 19 shows a section of a spacer profile of such a particularly advantageous twenty-first embodiment of the present invention. The section shows only the outer wall 14 of the spacer profile 1 in the area, where the diffusion barrier layer is arranged between the reinforcing layers 22, 24. This embodiment differs from the other embodiments only in that the diffusion barrier layer 266 is formed of a first layer 74, which is formed of a diffusion-proof EVOH material (as above, for example, "SoarnoL"), and a second layer 75, which is formed of polyolefin, for example, PE or PP. Furthermore, only those features that differ from the other embodiments are described.

The diffusion barrier layer 266 made of the first and second layer 74, 75 has basically the shape of the diffusion barrier layer 266 according to the sixteenth embodiment, which is depicted in FIG. 17*b*). In the present embodiment, the first layer 74 is formed between the reinforcing layers 22, 24 in accordance to the first area 70 of the sixteenth embodiment. The second layer 75 is formed and/or applied on the first layer 74 in accordance with the second area 71 of the sixteenth embodiment and its edges extend in the transverse direction X partially onto the sides of the reinforcing layers 22, 24 that face away from the outer wall 14. The first layer has a thickness d331 and the second layer has a thickness d332 in the height direction Y. The total thickness d333 preferably corresponds to the thickness d33 but can be greater or smaller.

The first layer 74 and the second layer 75 are preferably bonded to one another by using an adhesion agent 76 applied between the two layers and/or are preferably formed with one another by co-extrusion. A diffusion barrier is produced by the reinforcing layers 22, 24 and the two-layer diffusion barrier layer 266, which is bonded therewith in a diffusion-proof manner.

The diffusion barrier layer 266 may also have other shapes according to the twenty-first embodiment. For example, it may be formed according to the fifteenth to nineteenth embodiment. This means that the diffusion barrier layers 266 illustrated in the fifteenth to nineteenth embodiment each may also be made of a first EVOH layer and a second PP or PE layer. In each case it is preferable that the first layer 74 made of EVOH material is arranged between the second layer 75 made of polyolefin and the outer wall 14 such that it is protected from contact with water/water vapor. The first layer 74 and the second layer 75 may be also formed interchanged. This means that the first layer 74 may be formed on the side of the second layer 75 that faces away from the outer wall 14 and the second layer 75 may be applied directly onto the outer wall 14. However, in this case the first layer 74 made of the EVOH material is not protected from water or water vapor.

Furthermore, for example, in the embodiment shown in FIG. 17*d*), a PP/PE layer can be applied to the diffusion barrier layer 266 made of EVOH material between the reinforcing layers 22, 24 in order to protect the diffusion barrier layer 266 made of EVOH material from contact with water/water vapor.

In addition, the twentieth embodiment illustrated in FIG. 18 may be modified by applying a layer made of polyolefin (for example PP or PE) onto the outer wall 14 between the reinforcement layers 22, 24. The walls made of EVOH material would be thereby protected from contact with water/water vapor, so that an optimal diffusion impermeability would be ensured.

Furthermore, more than two layers made of EVOH/PP/PE also may be provided.

The features of the various embodiments may be combined with each other. Further, the reinforcing layers in one of the first to twentieth embodiment also may be formed asymmetrically to one another with respect to the symmetry plane L. The first reinforcing layer may differ in thickness/width with respect to the second reinforcing layer, and/or may be formed from a different material. The first or the second reinforcing layer may have an extension segment, while the other may have no extension segment. The reinforcing layers may also extend only to the side walls and the diffusion barrier layer may extend over the entire outer wall to connect the two reinforcing layers. The reinforcing layers also may optionally partially extend into the side walls and/or into the outer wall, but are always connected with the diffusion barrier layer on the outer wall.

The first or second reinforcing layer may extend over a larger portion on the outer wall than the other reinforcing layer. This means that the distance of the central section to the first side wall may be greater than the distance to the second side wall, and vice versa.

The central section is therefore not required to be centrally arranged between the side walls. Due to the non-central arrangement of the central section, the heat conduction through the spacer profile can be reduced. In particular, the heat conduction will be reduced if the central section is arranged closer to the "warm", i.e. inner, pane.

The diffusion barrier layer may be formed to overlap with the first and/or second reinforcing layer. This means, for example, that the diffusion barrier layer 26 shown in the first to thirteenth embodiments, which is applied directly onto the outer wall 14 in the central section 25 after the extrusion, may be applied partially onto the first and/or second reinforcing layer 22, 24. The diffusion barrier layer may therefore extend as one piece at least partially over the first reinforcing layer and the second reinforcing layer and between both on the outer wall. However, according to this construction, the diffusion barrier layer extends only to the area directly on the outer wall that is not covered by the first or second reinforcing layer. Due to an overlap, a particularly diffusion-proof design of the connection between reinforcing layers 22, 24 and diffusion barrier layer 26 is formed.

In the alternative to a notch, the side walls or portions thereof may also have areas that are formed so that a notch is omitted. For example, this can be achieved by forming side walls or portions thereof thinner-walled than others. The extension segments optionally may be omitted as well (see FIG. 11).

As an alternative to co-extrusion of reinforcing layers with the hollow profile body, the reinforcing layers can be applied directly on the hollow profile body after the extrusion of the hollow profile body, for example by adhesion or bonding agents. Further, the area provided for the reinforcing layer and/or diffusion barrier layer may be formed on the hollow profile body such that there are no shoulders at the edges and transitions between them after the application of the reinforcing layers and/or the diffusion barrier layer. This means that the areas, on which for example the reinforcing layers are applied, are formed as recesses in the hollow profile body already during the extrusion of the hollow profile body. Accordingly, the reinforcing layers and/or diffusion barrier layer are inset into these recesses.

The hollow profile body can also be formed trapezoidal, square, diamond shaped or otherwise of this nature. The concave bulges can assume other shapes, for example, they may be bulged out twice, be bulged asymmetrically, etc. In particular, the spacer profile may be also configured such that the side walls do not represent the outermost walls in the transverse direction X for attachment to the panes. Such a design could for example be designed as follows: the spacer profile has a wider inner wall compared to the outer wall. The side walls are not connected to the edges of the inner wall in the transverse direction X, but rather are offset slightly inward in the transverse direction X. The outer wall connected to the side walls, the side walls and the inner wall form the chamber. In addition, two other additional (sides) outer walls, which extend parallel to the side walls, are formed at the edges of the inner wall in the transverse direction X, which outer walls serve as attachment surfaces for the panes. The reinforcing layers are formed in such an embodiment wholly or partially in or on the additional outer walls and the side walls and the inner wall. The diffusion barrier layer bonds the reinforcing layers to one another in a diffusion-proof manner.

Figure 15:
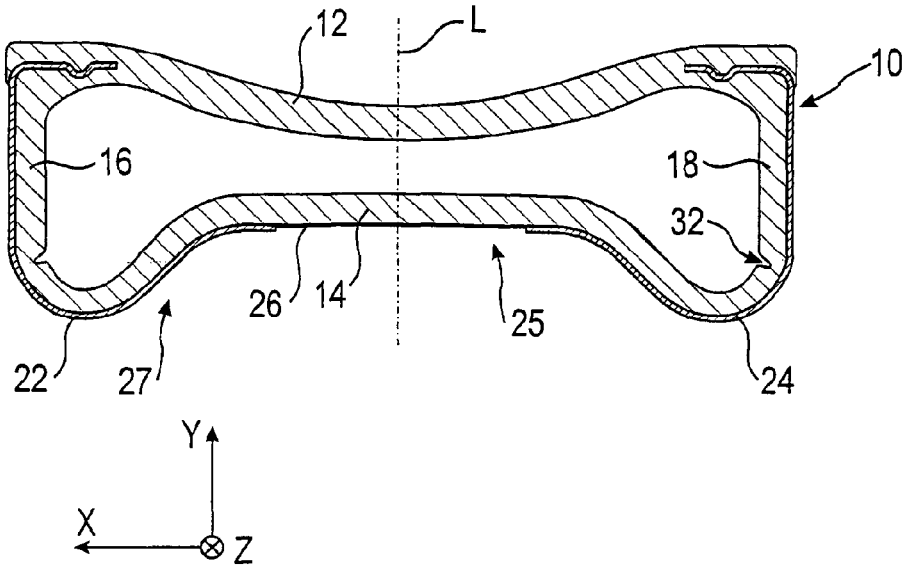
Figure 16:
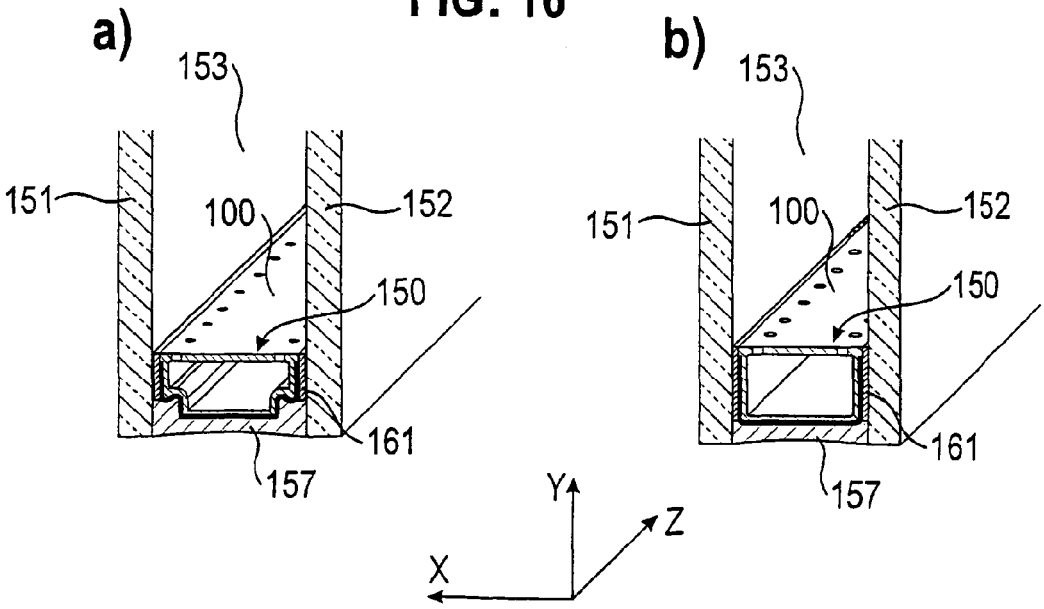

The wall thicknesses s1, s2 of the side walls 22, 24 and/or the outer wall 26 may be also differently designed from one another. The openings 34 may be also formed asymmetrically to the symmetry line L, as shown in FIG. 15, only centrally or only on one side with respect to the transverse direction X. The openings can be arranged at regular or irregular intervals in the longitudinal direction Z. The openings can be formed in one or more rows with respect to the transverse direction X.

A further reinforcing layer made of metallic material may be provided at least in part in or on the inner wall. The extension segments 28 can be bent into any shape, angled, etc., or be designed to be asymmetric relative to one another. The chamber also can be divided into several chambers by partition walls. The cross-section of the reinforcing layers need not necessarily be constant, but rather may also have a profile shape, so that it can be better connected with the hollow profile body. In particular, for example, knobs or grooves may be provided. The notches 32 and arches 21, 121 shown in the first to fourth embodiments are optional features which may be omitted depending on the design of the hollow profile body.

The first height h1 of the hollow profile body 10 in the height direction Y is preferably between 10 mm and 5 mm, more preferably between 8 mm and 6 mm, such as 6.85 mm, 7.5 mm and 8 mm.

The second height h2 of the arch 21 in the height direction Y is preferably between 1 mm and 0.05 mm, more preferably between 1 mm and 0.1 mm, such as 0.5 mm, 0.8 mm and 1 mm.

The third height h3 of the arch 121 in the height direction Y is preferably between 1.5 mm and 0.09 mm, more preferably between 0.5 mm and 0.05 mm, even more preferably between 0.3 mm and 0.07 mm, such as 0.1 mm, 0.12 mm and 0.15 mm.

The first width b1 of the hollow profile body 10 in the transverse direction X is preferably between 40 and 6 mm, more preferably between 20 mm and 6 mm, and even more preferably between 16 mm and 8 mm, such as 8 mm, 12 mm and 15.45 mm.

The first distance a1, corresponding to the second width b2, in the transverse direction X is preferably between 15 mm and 2 mm, more preferably between 8 mm and 5 mm, such as 5 mm, 6 mm and 8 mm.

The third width b3 of the diffusion barrier layer 266 is preferably between 35 mm and 2 mm, more preferably between 20 mm and 2 mm, even more preferably between 12 and 5, such as 6 mm, 7 mm and 9 mm.

The first thickness d1 of the first reinforcing layer 22 made of metallic material is preferably between 0.5 mm and 0.01 mm, more preferably between 0.2 mm and 0.01 mm, such as 0.1 mm, 0.05 mm and 0.01 mm.

The second thickness d2 of the second reinforcing layer 24 preferably corresponds to the first thickness d1.

The third thickness d3 of the diffusion barrier layer 26 made of metallic material is preferably between 0.09 mm and 1 nm, more preferably between 0.02 mm and 5 nm, and even more preferably between 0.01 mm and 10 nm, such as 0.01 mm, 0.001 mm and 10 nm.

The third thickness d33 of the diffusion barrier layer 266 made of EVOH material is preferably between 0.01 mm and 2 mm, more preferably between 0.05 mm and 0.8 mm, and even more preferably between 0.1 mm and 0.3 mm, such as 0.1 mm, 0.2 mm and 0.3 mm.

The thickness d331 of the second layer 75 made of PP or PE is preferably between 1.2 mm and 0.1 mm, more preferably between 1.00 mm and 0.5 mm, such as 0.5 mm, 0.6 mm and 0.7 mm.

The thickness d332 of the first layer 74 made of EVOH material is preferably between 0.01 mm and 2 mm, more preferably between 0.05 mm and 0.8 mm, and even more preferably between 0.1 mm and 0.3 mm, such as 0.1 mm, 0.2 mm and 0.3 mm.

The first length l1 of the extension segments in the transverse direction X is preferably 0.05 b1<l1<0.8 b1, more preferably 0.1 b1<l1<0.5 b1 and even more preferably 0.1 b1<l1<0.2 b1 mm.

The first wall thickness s1 of the side walls 16, 18 and the outer wall 14 is preferably between 1.2 mm and 0.2 mm, more preferably between 1.00 mm and 0.5 mm, such as 0.5 mm, 0.6 mm and 0.7 mm.

The second wall thickness s2 of the inner wall 12 is preferably between 1.5 mm and 0.5 mm, such as 0.7 mm, 0.8 mm, 0.9 mm and 1 mm.

The first length l1 in the transverse direction X is less than b1/2.

It is explicitly stated that all features disclosed in the description and/or the claims should be considered separately and independently from one another for the purpose of original disclosure as well as for restricting the claimed invention independently from the combinations of features in the embodiments and/or the claims. It is explicitly stated that all value ranges or indications of groups of units disclose every possible intermediate value of the sub-group of units for the purpose of original disclosure as well as for the purpose of restricting the claimed invention, especially as the limit of a range specification.

LIST OF REFERENCE NUMERALS

1 spacer profile
10 hollow profile body
12 inner wall
14 outer wall
16 first side wall
18 second side wall
20 chamber
21, 121 arch
22 first reinforcing layer
24 second reinforcing layer
25 central section
26, 266 diffusion barrier layer
27 diffusion barrier
28 extension segment
29 bend in the extension segment
30 groove in the extension segment
31 accommodation portion
32 notch
34 opening
35 opening
36 transverse crosspiece
40 connecting portion
70 first area
71 second area
72 overlapping area
73 continuous plane
74 first layer
75 second layer
76 adhesion agent

The invention claimed is:

1. A spacer profile configured to be used in a spacer frame of an insulating pane unit for door or window or facade elements, the insulating pane unit comprising at least first and second panes having an intervening space defined therebetween, the spacer profile comprising:

a hollow profile body made of a synthetic material and having a chamber configured to accommodate hygroscopic material defined therein, the hollow profile body extending in a longitudinal direction (Z) and comprising:

an inner wall configured to face towards the intervening space between the panes in an assembled state of the insulating pane unit and to border the chamber, an outer wall disposed opposite to the inner wall in a height direction (Y), which is perpendicular to the longitudinal direction (Z), a first side wall, and a second side wall disposed opposite to the first side wall in a transverse direction (X), which is perpendicular to the longitudinal direction (Z) and to the height direction (Y), the first and second side walls respectively being connected with the inner wall and the outer wall to form the chamber;

a first reinforcement layer made of a first metallic material having a first specific heat conductivity ($\lambda_1$), the first reinforcement layer extending in the longitudinal direction (Z) in one piece at least in part on the first side wall, having a constant cross section perpendicular to and in the longitudinal direction (Z), and having a first thickness (d1);

a second reinforcement layer made of a second metallic material having a second specific heat conductivity ($\lambda_2$), the second reinforcement layer extending in the longitudinal direction (Z) in one piece at least in part on the second side wall, having a constant cross-section perpendicular to and in the longitudinal direction (Z), spaced by a first distance from the first reinforcement layer, and having a second thickness (d2); and a diffusion barrier layer having a third thickness (d3; d33) and a third specific heat conductivity ($\lambda_3$, $\lambda_{33}$), the diffusion barrier layer being disposed on the outer wall at least between the first reinforcement layer and the second reinforcement layer and being connected with the first reinforcement layer and the second reinforcement layer in a diffusion-proof manner to form a diffusion barrier;

wherein the multiplication product of the third specific heat conductivity ($\lambda_3$, $\lambda_{33}$) and the third thickness (d3; d33) is less than both (i) the multiplication product of the first specific heat conductivity ($\lambda_1$) and the first thickness (d1) and (ii) the multiplication product of the second specific heat conductivity ($\lambda_2$) and the second thickness (d2), and the diffusion barrier layer is disposed substantially on a neutral axis, which is defined by bending the spacer profile by 90° about an axis parallel to the transverse direction (X) with the inner wall lying further inward than the outer wall with reference to the bending radius.

2. The spacer profile according to claim 1, wherein the diffusion barrier layer is made of a third metallic material and the third thickness (d3) is less than both the first thickness (d1) and the second thickness (d2).

3. The spacer profile according to claim 2, wherein:

the first specific heat conductivity is between 10 W/(mK)$\leq\lambda_1\leq$50 W/(mK) and the first thickness (d1) is between 0.1 mm and 0.3 mm, the second specific heat conductivity is between 10 W/(mK)$\leq\lambda_2\leq$50 W/(mK) and the second thickness (d2) is between 0.1 mm and 0.3 mm, and the third specific heat conductivity is between 14 W/(mK)$\leq\lambda_3\leq$200 W/(mK) and the third thickness (d3) is between 0.001 mm and 0.015 mm.

4. The spacer profile according to claim 3, wherein the diffusion barrier layer extends perpendicular to and in the longitudinal direction (Z) in one piece on the outer wall only between the first and second reinforcement layers.

5. The spacer profile according to claim 3, wherein the diffusion barrier layer is not disposed between the hollow profile body and one or both of the first reinforcement layer and the second reinforcement layer.

6. The spacer profile according to claim 1, wherein the diffusion barrier layer is not disposed between the hollow profile body and one or both of the first reinforcement layer and the second reinforcement layer.

7. The spacer profile according to claim 1, wherein the diffusion barrier layer extends perpendicular to and in the longitudinal direction (Z) in one piece on the outer wall only between the first and second reinforcement layers.

8. The spacer profile according to claim 1, wherein the diffusion barrier layer extends perpendicular to and in the longitudinal direction (Z) on at least a part of the first reinforcement layer that faces towards the second reinforcement layer and/or on at least part of the second reinforcement layer that faces towards the first reinforcement layer.

9. The spacer profile according to claim 1, wherein the spacer profile has been bent about the axis parallel to the transverse direction (X) such that an angle of 90° is formed by portions of the outer wall that have been bent relative to each other and the inner wall lies further inwardly than the outer wall with respect to the bending radius, and the diffusion barrier layer between the reinforcement layers is at least substantially uncompressed and unstretched.

10. A spacer profile configured to be used in a spacer frame of an insulating pane unit for door or window or facade elements, the insulating pane unit comprising at least first and second panes having an intervening space defined therebetween, the spacer profile comprising:

a hollow profile body made of a synthetic material and having a chamber configured to accommodate hygroscopic material defined therein, the hollow profile body extending in a longitudinal direction (Z) and comprising:

an inner wall configured to face towards the intervening space between the panes in an assembled state of the insulating pane unit and to border the chamber, an outer wall disposed opposite to the inner wall in a height direction (Y), which is perpendicular to the longitudinal direction (Z), a first side wall, and a second side wall disposed opposite to the first side wall in a transverse direction (X), which is perpendicular to the longitudinal direction (Z) and to the height direction (Y), the first and second side walls respectively being connected with the inner wall and the outer wall to form the chamber;

a first reinforcement layer made of a first metallic material having a first specific heat conductivity ($\lambda_1$), the first reinforcement layer extending in the longitudinal direction (Z) in one piece at least in part on the first side wall, having a constant cross section perpendicular to and in the longitudinal direction (Z), and having a first thickness (d1);

a second reinforcement layer made of a second metallic material having a second specific heat conductivity ($\lambda_2$), the second reinforcement layer extending in the longitudinal direction (Z) in one piece at least in part on the second side wall, having a constant cross-section perpendicular to and in the longitudinal direction (Z), spaced by a first distance from the first reinforcement layer, and having a second thickness (d2); and a diffusion barrier layer comprising at least a first layer made of a diffusion-proof EVOH-plastic material having a third thickness (d33) and a third specific heat conductivity ($\lambda_{33}$), the diffusion barrier layer being disposed on the outer wall at least between the first reinforcement layer and the second reinforcement layer and being connected with the first reinforcement layer and the second reinforcement layer in a diffusion-proof manner to form a diffusion barrier;

wherein the multiplication product of the third specific heat conductivity ($\lambda_3$, $\lambda_{33}$) and the third thickness (d3; d33) is less than both (i) the multiplication product of the first specific heat conductivity ($\lambda_1$) and the first thickness (d1) and (ii) the multiplication product of the second specific heat conductivity ($\lambda_2$) and the second thickness (d2).

11. The spacer profile according to claim 10, wherein the hollow profile body and the diffusion barrier layer are integrally made of the diffusion-proof EVOH-plastic material.

12. The spacer profile according to claim 10, wherein the diffusion barrier layer further comprises at least a second layer made of polyolefin, the second layer being applied onto the first layer.

13. The spacer profile according to claim 12, wherein the diffusion barrier layer extends perpendicular to and in the longitudinal direction (Z) on at least a part of the first reinforcement layer that faces towards the second reinforcement layer and/or on at least part of the second reinforcement layer that faces towards the first reinforcement layer.

14. The spacer profile according to claim 10, wherein the third thickness (d33) of the diffusion barrier layer is greater than the first thickness (d1) and/or the second thickness (d2).

15. The spacer profile according to claim 10, wherein the diffusion barrier layer is not disposed between the hollow profile body and one or both of the first reinforcement layer and the second reinforcement layer.

16. The spacer profile according to claim 10, wherein the diffusion barrier layer extends perpendicular to and in the longitudinal direction (Z) in one piece on the outer wall only between the first and second reinforcement layers.

17. The spacer profile according to claim 10, wherein the diffusion barrier layer extends perpendicular to and in the longitudinal direction (Z) on at least a part of the first reinforcement layer that faces towards the second reinforcement layer and/or on at least part of the second reinforcement layer that faces towards the first reinforcement layer.

18. The spacer profile according to claim 10, wherein the spacer profile has been bent about an axis parallel to the transverse direction (X) such that an angle of 90° is formed by portions of the outer wall that have been bent relative to each other and the inner wall lies further inwardly than the outer wall with respect to the bending radius, and the diffusion barrier layer between the reinforcement layers is at least substantially uncompressed and unstretched.

19. An insulating pane unit comprising:

at least first and second panes arranged opposite to each other and spaced apart to form an intervening space therebetween, and a spacer frame made of the spacer profile according to claim 10, the spacer frame being arranged between the first and second panes such that outer sides of the first and second side walls in the lateral direction (X) are bonded by a diffusion-proof adhesive material to inward-facing sides of the respective first and second panes and such that the spacer frame at least partially delimits the intervening space between the first and second panes.

20. An insulating pane unit comprising:

at least first and second panes arranged opposite to each other and spaced apart to form an intervening space therebetween, and a spacer frame made of the spacer profile according to claim 1, the spacer frame being arranged between the first and second panes such that outer sides of the first and second side walls in the lateral direction (X) are bonded by a diffusion-proof adhesive material to inward-facing sides of the respective first and second panes and such that the spacer frame at least partially delimits the intervening space between the first and second panes.

* * * * *